US007662207B2

(12) United States Patent
Miura et al.

(10) Patent No.: US 7,662,207 B2
(45) Date of Patent: Feb. 16, 2010

(54) NANO-CRYSTAL AUSTENITIC STEEL BULK MATERIAL HAVING ULTRA-HARDNESS AND TOUGHNESS AND EXCELLENT CORROSION RESISTANCE, AND METHOD FOR PRODUCTION THEREOF

(75) Inventors: Harumatsu Miura, Takarazuka (JP); Nobuaki Miyao, Neyagawa (JP); Hidenori Ogawa, Settsu (JP); Kazuo Oda, Yamaguchi (JP); Munehide Katsumura, Takamatsu (JP); Masaru Mizutani, Tokyo (JP)

(73) Assignee: Nano Technology Institiute, Inc., Hagi-shi, Yamaguchi (JP)

( * ) Notice: Subject to any disclaimer, the term of this patent is extended or adjusted under 35 U.S.C. 154(b) by 690 days.

(21) Appl. No.: 10/529,418

(22) PCT Filed: Sep. 26, 2003

(86) PCT No.: PCT/JP03/12343

§ 371 (c)(1),
(2), (4) Date: Feb. 13, 2006

(87) PCT Pub. No.: WO2004/029312

PCT Pub. Date: Apr. 8, 2004

(65) Prior Publication Data

US 2006/0193742 A1 Aug. 31, 2006

(30) Foreign Application Priority Data

Sep. 27, 2002 (JP) ..... 2002-284576

(51) Int. Cl.
*B22F 3/00* (2006.01)

(52) U.S. Cl. ..... 75/246; 75/232; 75/244

(58) Field of Classification Search ..... 75/232, 75/244, 246; 419/32, 33
See application file for complete search history.

(56) References Cited

U.S. PATENT DOCUMENTS

| | | | | |
|---|---|---|---|---|
| 4,999,052 | A * | 3/1991 | Wilson | 148/513 |
| 5,723,799 | A * | 3/1998 | Murayama et al. | 75/232 |
| 5,841,046 | A * | 11/1998 | Rhodes et al. | 75/246 |
| 5,908,486 | A * | 6/1999 | Flinn et al. | 75/232 |

FOREIGN PATENT DOCUMENTS

| | | |
|---|---|---|
| EP | 1234894 | 8/2002 |
| JP | 10-88289 | 4/1998 |
| JP | 11-43748 | 2/1999 |

OTHER PUBLICATIONS

Current Advances in Materials and Processes, vol. 15, No. 3, (2002), pp. 454 to 457.
Current Advances in Materials and Processes, vol. 13, No. 3, (2002), pp. 362 to 363.
Harumatsu Miura, "Mechanical Alloying ni yori Sakusei shita Kochiso Nano Kessho Austentite Stainless-ko Funmatsu no Neddan Koka Seikei Katei deno Chisso no Kyodo", Current Advances in Materials and Processes, vol. 15, No. 3, (2002), pp. 454 to 457.
Harumatsu Miura, "Mechanical Alloying ni yotte Sakusei shita Kochiso Stainless-ko Funmatsu no Austentite-ka to Koka Seikei", Current Advances in Materials and Processes, vol. 13, No. 3, (2000), pp. 362 to 363.
Harumatsu Miura,, Preparation of Nanocrystalline High-Nitrogen Stainless Steel Powders by Mechanical Alloying and Their HotCompaction, Materials Transactions, vol. 42, No. 11, (2001), pp. 2368 to 2373.
Miura H et al, "Composition Dependence of Microstructure of Mechanically Alloyed Powders and Their Compacts of High Nitrogen CR-MN Steels", Materials Transactions, Jim, Sendai, JP, vol. 40, No. 9, Sep. 1999, pp. 907-910.

* cited by examiner

*Primary Examiner*—Roy King
*Assistant Examiner*—Ngoclan T Mai
(74) *Attorney, Agent, or Firm*—patenttm.us

(57) ABSTRACT

The invention provides a super hard and tough, nano-crystal austenite steel bulk material having an improved corrosion resistance, and its preparation process.

The austenite steel bulk material comprises an aggregate of austenite nano-crystal grains containing 0.1 to 2.0% (by mass) of a solid solution type nitrogen, wherein an oxide, nitride, carbide or the like of a metal or semimetal exists as a crystal grain growth inhibitor between and/or in said nano-crystal grains.

For preparation, fine powders of austenite steel-forming components, i.e., iron and chromium, nickel, manganese, carbon or the like are mixed with a substance that becomes a nitrogen source. Mechanical alloying (MA) is applied to the mixture, thereby preparing nano-crystal austenite steel powders having a high nitrogen concentration. Finally, the austenite steel powders are consolidated by sintering by means of spark plasma sintering, rolling or the like.

27 Claims, 12 Drawing Sheets

NANO-CRYSTAL AUSTENITIC STEEL BULK MATERIAL HAVING ULTRA-HARDNESS AND TOUGHNESS AND EXCELLENT CORROSION RESISTANCE, AND METHOD FOR PRODUCTION THEREOF

ART FIELD

The present invention relates generally to a metal material, and more particularly to a super hard and tough nano-crystal austenite steel bulk material with an improved corrosion resistance, and its preparation process.

BACKGROUND OF THE INVENTION

As the Hall-Petch relationship teaches, metal material strength increases with decreasing crystal grain diameter D, and such strength dependency on grain diameter holds even at or near D=50 to 100 nm that means nano-size level crystal grains. Thus, reducing crystal grain diameters down to the ultra-fine, nano-size levels now becomes one of the most important means ever for the reinforcement of metal materials. Some technical journals suggest that reducing D down to ultra-fine sizes of as fine as a few nm causes superplasticity to come out.

There are also some reports that regarding magnetic elements such as iron, cobalt and nickel, in nano-order grain ranges coercive force decreases and soft magnetism improves with decreasing D, which are not found when the crystal grain diameter D is in micron-order ranges.

However, the crystal grain diameter D of most metal materials produced by melting are usually on the order of a few microns to a few tens of microns, and D can hardly be reduced down to the nano-order even by post-treatments. Even with controlled rolling that is an important micro-processing of steel crystal grains, for instance, the lowest possible limit to grain diameters is of the order of at most 4 to 5 μm. In other words, with such ordinary processes it is impossible to obtain materials whose grain diameters are reduced down to the nano-size level.

For instance, intermetallic compounds such as $Ni_3Al$, $Co_3Ti$, $Ni_3(Si, Ti)$ and TiAl that provide useful heat-resistant materials and super hard materials, and oxide- and non-oxide based ceramic materials such as $Al_2O_3$, $ZrO_2$, TiC, $Cr_3C_2$, TiN and $TiB_2$ are all generally less susceptible to plastic processing at normal temperature because of being fragile, and forming processes using super plasticity in relatively high temperature regions become very important.

For the development of superplasticity, however, it is required to reduce their crystal grain diameters down to the nano-size level or an nano-order close thereto. Never until now are there any ultra-fine powders sufficient to meet such forming processes available.

As nitrogen (N) in an amount of, e.g., about 0.9% (by mass) is added to a chromium-nickel type stainless steel having a composition equivalent to that of SUS 304 that is typical austenite stainless steel, the resulting stainless steel having a high nitrogen concentration increases in offset yield strength (yield strength) to about three times as high as that of SUS 304 stainless steel, with no decrease in fracture toughness yet with much more improvements in corrosion resistance in general and pitting corrosion resistance in particular and much more reductions in sensitivity to stress corrosion cracking. Moreover, nitrogen, because of being an extremely strong austenite-stabilization element, is not only capable of superseding expensive nickel with no damage to the above strength properties and corrosion resistance, but also has superior properties such as the effect on holding back process-inducing martensitic transformation under intensive cold processing conditions.

Such effects of N are also true for chromium-manganese type austenite steels. From such considerations, chromium-nickel and chromium-manganese type austenite steels having a high nitrogen concentration have recently attracted considerable attentions as the coming generation of promising new materials.

So far, high-N austenite steels having nitrogen in an amount of up to about 0.1 to 2% (by mass) have been manufactured by melting solidification processes usually in nitrogenous atmospheres, high-temperature solid diffusion sintering processes in nitrogen gas atmospheres, etc. With those processes, however, it is required that the higher the concentration of nitrogen in the end steel, the higher the pressure of nitrogen gas in the atmosphere, offering problems in connection with high-temperature, high-pressure operations and work safety.

Referring here to generally available steel materials inclusive of austenite steel, the finer the crystal grains, the ever higher the effect on strength (hardness) becomes, as is the case with other metals, and high-N austenite steel, too, is now intensively studied for much finer crystal grain diameters. However, it is still very difficult to reduce crystal grains down to the nano-size level; any satisfactory ultra-fine crystal grain material is not achievable as yet, although some high-N austenite steels having a crystal grain structure of the order of a few tens of μm are somehow obtainable.

But then, in high-manganese austenite that attracts great attention as a steel species that could have a dominant role in the coming generation of large-scale technologies (peripheral technologies in linear motor cars, superconduction applied systems, etc.), too, any material having a crystal grain structure of the nano-order is not available as yet, as is the case with the chromium-nickel, and chromium-manganese type austenite steels.

DISCLOSURE OF THE INVENTION

The present invention has for its objection the provision of satisfactory solutions to the above problems.

Basically, the present invention makes use of mechanical milling (MM) or mechanical alloying (MA) of a powder mixture of powders of an elementary single metal and powders of other metal additives or the like. The resulting nano-crystal fine powders are consolidated by forming-by-sintering, thereby providing a bulk material, composed of an aggregate of grains of nano-size levels, and having strength (high strength) or hardness (super hardness) close to the finest possible limit. Furthermore, crystal grains of magnetic elements such as iron, cobalt and nickel are reduced down to nano-size levels so as to provide a novel material showing much better soft magnetism.

The present invention also provides a novel process for preparing a non-magnetic, high-nitrogen nano-crystal austenite steel material having super hardness and toughness with an improved corrosion resistance (pitting-corrosion resistance) by applying mechanical alloying (MA) to an elementary powder mixture of iron and chromium, nickel, manganese, carbon or the like with a nitrogen source substance such as iron nitride, using a ball mill or the like and then applying forming-by-sintering to the resultant nano-crystal austenite steel fine powders, thereby obtaining a nano-crystal austenite steel bulk material containing a solid-solution type nitrogen in an amount of preferably 0.1 to 2.0% (by mass), more preferably 0.3 to 1.0% (by mass), and even more preferably 0.4 to 0.9% (by mass).

Furthermore, the present invention provides a high-manganese austenite steel having a nano-order crystal structure through the application of mechanical alloying and forming-by-sintering similar to that mentioned above.

Thus, the present invention is concerned with austenite steel bulk materials constructed as recited below, and their preparation processes and uses.

(1) A super hard and tough austenite steel bulk material with an improved corrosion resistance, comprising an aggregate of austenite nano-crystal grains containing a solid-solution type nitrogen in an amount of 0.1 to 2.0% (by mass), characterized in that a metal oxide or a semimetal oxide exists as a crystal grain growth inhibitor between or in said nano-crystal grains, or between and in said nano-crystal grains.

(2) A super hard and tough austenite steel bulk material with an improved corrosion resistance, comprising an aggregate of austenite nano-crystal grains containing a solid-solution type nitrogen in an amount of 0.1 to 2.0% (by mass), characterized in that a metal nitride or a semimetal nitride exists as a crystal grain growth inhibitor between or in said nano-crystal grains, or between and in said nano-crystal grains.

(3) A super hard and tough austenite steel bulk material with an improved corrosion resistance, comprising an aggregate of austenite nano-crystal grains containing a solid-solution type nitrogen in an amount of 0.1 to 2.0% (by mass), characterized in that a metal carbide or a semimetal carbide exists as a crystal grain growth inhibitor between or in said nano-crystal grains, or between and in said nano-crystal grains.

(4) A super hard and tough austenite steel bulk material with an improved corrosion resistance, comprising an aggregate of austenite nano-crystal grains containing a solid-solution type nitrogen in an amount of 0.1 to 2.0% (by mass), characterized in that a metal silicide or a semimetal silicide exists as a crystal grain growth inhibitor between or in said nano-crystal grains, or between and in said nano-crystal grains.

(5) A super hard and tough austenite steel bulk material with an improved corrosion resistance, comprising an aggregate of austenite nano-crystal grains containing a solid-solution type nitrogen in an amount of 0.1 to 2.0% (by mass), characterized in that a metal boride or a semimetal boride exists as a crystal grain growth inhibitor between or in said nano-crystal grains, or between and in said nano-crystal grains.

(6) A super hard and tough austenite steel bulk material with an improved corrosion resistance, comprising an aggregate of austenite nano-crystal grains containing a solid-solution type nitrogen in an amount of 0.1 to 2.0% (by mass), characterized in that at least two selected from the group consisting of (1) a metal oxide or a semimetal oxide, (2) a metal nitride or a semimetal nitride, (3) a metal carbide or a semimetal carbide, (4) a metal silicide or a semimetal silicide and (5) a metal boride or a semimetal boride exist as a crystal grain growth inhibitor between or in said nano-crystal grains, or between and in said nano-crystal grains.

(7) The super hard and tough nano-crystal austenite steel bulk material with an improved corrosion resistance according to any one of (1) to (6) above, characterized in that said austenite steel bulk material comprising an aggregate of austenite nano-crystal grains containing 0.1 to 2.0% (by mass) of a solid-solution type nitrogen contains in a structure thereof less than 50% of ferrite nano-crystal grains.

(8) The super hard and tough nano-crystal austenite steel bulk material with an improved corrosion resistance according to any one of (1) to (7) above, characterized in that said bulk material comprising an aggregate of austenite nano-crystal grains containing 0.1 to 2.0% (by mass) of a solid-solution type nitrogen contains 0.1 to 5.0% (by mass) of nitrogen.

Referring now to the significance of why the above nano-crystal austenite steel bulk material should contain 0.1 to 5.0% by mass of nitrogen, nitrogen contents of less than 0.1% are less effective for increases in the hardness of that bulk material; however, insofar as the nitrogen content is in the range of 0.1 to 5.0% by mass, the hardness increases with increasing nitrogen content.

As the nitrogen content is greater than 5.0%, however, there is not only no noticeable increase in the hardness of the bulk material but also a noticeable decrease in toughness.

Referring then to the advantages obtained by allowing the austenite nano-crystal grains that form part of the nano-crystal austenite steel bulk material to contain 0.1 to 2.0% (by mass) of a solid-solution type nitrogen, insofar as the solid-solution type nitrogen concentration (content) is in the range of 0.1 to 2.0% by mass, much of the nitrogen forms an effective solid solution with an austenite crystal matrix, so that the hardness and strength of that bulk material increase largely with increasing nitrogen content. In addition, especially when the nitrogen concentration is in the range of 0.1 to 0.9% (by mass) as mentioned later, a nano-crystal austenite steel bulk material much higher in toughness is obtainable.

(9) The super hard and tough nano-crystal austenite steel bulk material with an improved corrosion resistance according to any one of (1), (6) and (7) above, characterized in that said austenite steel bulk material comprising austenite nano-crystal grains containing 0.1 to 2.0% (by mass) of a solid-solution type nitrogen or an aggregate thereof contains 0.01 to 1.0% (by mass) of oxygen in a metal oxide or semimetal oxide form.

(10) The super hard and tough nano-crystal austenite steel bulk material with an improved corrosion resistance according to any one of (2), (6), (7) and (8) above, characterized in that said bulk material comprising an aggregate of austenite nano-crystal grains containing 0.1 to 2.0% (by mass) of a solid-solution type nitrogen contains a nitrogen compound in an amount of 1 to 30% (by mass).

(11) The super hard and tough nano-crystal austenite steel bulk material with an improved corrosion resistance according to any one of (1) to (10) above, characterized in that said bulk material comprising an aggregate of austenite nano-crystal grains containing 0.1 to 2.0% (by mass) of a solid-solution type nitrogen comprises a nitrogen-affinity metal element that has a stronger chemical affinity for nitrogen than iron, such as niobium, tantalum, manganese, and chromium, so as to prevent denitrification during a forming-by-sintering process thereof.

(12) The super hard and tough nano-crystal austenite steel bulk material with an improved corrosion resistance according to any one of (1) to (11) above, characterized in that said bulk material comprising an aggregate of austenite nano-crystal grains containing 0.1 to 2.0% (by mass) of a solid-solution type nitrogen has a steel forming and blending composition comprising 12 to 30% (by mass) of Cr, 0 to 20% (by mass) of Ni, 0 to 30% (by mass) of Mn, 0.1 to 5% (by mass) of N and 0.02 to 1.0% (by mass) of C with the rest being substantially Fe.

(13) The super hard and tough nano-crystal austenite steel bulk material with an improved corrosion resistance according to any one of (1) to (9) above, characterized in that said bulk material comprising an aggregate of austenite nano-crystal grains containing 0.1 to 2.0% (by mass) of a solid-solution type nitrogen has a steel forming and blending composition comprising 12 to 30% (by mass) of Cr, 0 to 20% (by mass) of Ni, 0 to 30% (by mass) of Mn, up to 30% (by mass) of N (of a compound type) and 0.01 to 1.0% (by mass) of C with the rest being substantially Fe.

(14) The super hard and tough nano-crystal austenite steel bulk material with an improved corrosion resistance according to any one of (1) to (11) above, characterized in that said bulk material comprising an aggregate of austenite nano-crystal grains containing 0.1 to 2.0% (by mass) of a solid-solution type nitrogen has a steel forming and blending composition comprising 4 to 40% (by mass) of Mn, 0.1 to 5% (by mass) of N, 0.1 to 2.0% (by mass) of C and 3 to 10% (by mass) of Cr with the rest being substantially Fe.

(15) The super hard and tough nano-crystal austenite steel bulk material with an improved corrosion resistance according to any one of (1) to (11) above, characterized in that said bulk material comprising an aggregate of austenite nano-crystal grains containing 0.1 to 2.0% (by mass) of a solid-solution type nitrogen has a steel forming and blending composition comprising 4 to 40% (by mass) of Mn, up to 30% (by mass) of N (of a compound type), 0.1 to 2.0% (by mass) of C and 3 to 10% (by mass) of Cr with the rest being substantially Fe.

(16) The super hard and tough nano-crystal austenite steel bulk material with an improved corrosion resistance according to any one of (1) to (15) above, characterized in that said austenite nano-crystal grains containing 0.1 to 2.0% (by mass) of a solid-solution type nitrogen have been obtained by mechanical alloying (MA) using a ball mill or the like.

(17) The super hard and tough nano-crystal austenite steel bulk material with an improved corrosion resistance according to any one of (1) to (16) above, characterized by comprising an aggregate of austenite nano-crystal grains containing 0.3 to 1.0% (by mass) of a solid-solution type nitrogen and having a crystal grain diameter of 50 to 1,000 nm.

(18) The super hard and tough nano-crystal austenite steel bulk material with an improved corrosion resistance according to any one of (1) to (16) above, characterized by comprising an aggregate of austenite nano-crystal grains containing 0.4 to 0.9% (by mass) of a solid-solution type nitrogen and having a crystal grain diameter of 75 to 500 nm.

(19) The super hard and tough nano-crystal austenite steel bulk material with an improved corrosion resistance according to any one of (1) to (16) above, characterized by comprising an aggregate of austenite nano-crystal grains containing 0.4 to 0.9% (by mass) of a solid-solution type nitrogen and having a crystal grain diameter of 100 to 300 nm.

Referring here to the advantages obtained by allowing the austenite nano-crystal grains that form part of the nano-crystal austenite steel bulk material to contain the solid-solution type nitrogen in an amount of preferably 0.3 to 1.0% (by mass), and more preferably 0.4 to 0.9% (by mass), the content of the solid-solution type nitrogen of less than 0.3% is incapable of significantly increasing the hardness of the bulk material, whereas the content of greater than 1.0% does not give rise to any improvement in toughness, although there is some increase in the hardness of the bulk material. In the content range of 0.3 to 1.0% (by mass), especially 0.4 to 0.9% (by mass), much higher hardness is obtained in combination with high toughness.

Referring then to the significance of why the austenite nano-crystal grains that form part of the nano-crystal austenite steel bulk material should have a crystal grain diameter of preferably 50 to 1,000 nm, more preferably 75 to 500 nm, and even more preferably 100 to 300 nm, crystal grain diameters of less than 50 nm do not provide any practical material, because the bulk material is less susceptible to plastic processing due to the fact that there is an extreme decrease in the density of dislocations that provide a medium for plastic deformation. As the crystal grain diameters exceed 1,000 nm, on the other hand, offset yield strength (strength) drops unavoidably, although the bulk material is capable of easy plastic processing because there is an increased dislocation density. If the bulk material has an austenite crystal grain diameter of preferably 50 to 1,000 nm, more preferably 75 to 500 nm, and even more preferably 100 to 300 nm, then it offers an ideal austenite steel bulk material that has high offset yield strength (strength) and is capable of easier plastic processing.

It is here noted that in applications where no extremely high strength is needed, it is preferable to bring the annealing temperature of the bulk material after formed by sintering up to about 1,200° C. to 1,250° C., because within a shorter period of time it is possible to produce an austenite steel bulk material having a large crystal grain diameter of up to about 5,000 nm (5 μm) or larger, which is hardly produced by melting processes.

(20) A process for preparing a nano-crystal austenite steel bulk material, characterized by involving steps of:

mixing fine powders of respective austenite steel forming components such as iron and chromium, nickel, manganese, carbon or the like together with a substance that becomes a nitrogen source, applying mechanical alloying (MA) to a mixture, using a ball mill or the like, thereby preparing fine powders of nano-crystal austenite steel having a high nitrogen concentration, and applying to said fine powders of said nano-crystal austenite steel forming-by-sintering treatment such as forming-by-sintering using one means selected from the group consisting of (1) rolling, (2) spark plasma sintering, (3) extrusion, (4) hot isostatic press sintering (HIP), (5) cold isostatic pressing (CIP), (6) cold pressing, (7) hot pressing, (8) forging, and (9) swaging or two or more thereof in combination or explosive forming, thereby obtaining a super hard and tough austenite steel bulk material with an improved corrosion resistance, which comprises an aggregate of austenite nano-crystal grains containing 0.1 to 2.0% (by mass) of a solid-solution type nitrogen.

(21) A process for preparing a nano-crystal austenite steel bulk material, characterized by involving steps of:

mixing fine powders of respective austenite steel forming components such as iron and chromium, nickel, manganese, carbon or the like together with a substance that becomes a nitrogen source, applying mechanical alloying (MA) to a mixture, using a ball mill or the like, thereby preparing fine powders of nano-crystal austenite steel having a high nitrogen concentration, and applying to said fine powders of said nano-crystal austenite steel forming-by-sintering treatment in air, an oxidation-inhibition atmosphere or a vacuum such as at least one means selected from the group consisting of (1) rolling, (2) spark plasma sintering, (3) extrusion, (4) hot isostatic press sintering (HIP), (5) hot pressing, (6) forging, and (7) swaging or two or more thereof in combination, or explosive forming, followed by quenching, thereby obtaining a super hard and tough austenite steel bulk material with an improved corrosion resistance, which comprises an aggregate of austenite nano-crystal grains containing 0.1 to 2.0% (by mass) of a solid-solution type nitrogen.

(22) A process for preparing a nano-crystal austenite steel bulk material, characterized by involving steps of:

mixing fine powders of respective austenite steel forming components such as iron and chromium, nickel, manganese, carbon or the like together with a substance that becomes a nitrogen source, applying mechanical alloying (MA) to a mixture, using a ball mill or the like, thereby preparing fine powders of nano-crystal austenite steel having a high nitrogen concentration, and applying spark plasma sintering to said fine powders of said nano-crystal austenite steel in a vacuum or an oxidization-inhibition atmosphere for forming-by-sintering, thereby obtaining a super hard and tough austenite steel bulk material with an improved corrosion resistance, which comprises an aggregate of austenite nano-crystal grains containing preferably 0.3 to 1.0% (by mass), more preferably 0.4 to 0.9% (by mass) of a solid-solution type nitrogen, and having a crystal grain diameter of preferably 50 to 1,000 nm, more preferably 75 to 500 nm, even more preferably 100 to 300 nm.

(23) A process for preparing a nano-crystal austenite steel bulk material, characterized by involving steps of:

mixing fine powders of respective austenite steel forming components such as iron and chromium, nickel, manganese, carbon or the like together with a substance that becomes a nitrogen source, applying mechanical alloying (MA) to a mixture, using a ball mill or the like, thereby preparing fine powders of nano-crystal austenite steel having a high nitrogen concentration, and applying spark plasma sintering to said fine powders of said nano-crystal austenite steel in a vacuum or an oxidization-inhibition atmosphere for forming-by-sintering, followed by rolling and quenching, thereby obtaining a super hard and tough austenite steel bulk material with an improved corrosion resistance, which comprises an aggregate of austenite nano-crystal grains containing preferably 0.3 to 1.0% (by mass), more preferably 0.4 to 0.9% (by mass) of a solid-solution type nitrogen, and having a crystal grain diameter of preferably 50 to 1,000 nm, more preferably 75 to 500 nm, even more preferably 100 to 300 nm.

(24) The process for preparing a nano-crystal austenite steel bulk material according to (20) or (22) above, characterized in that said quenched formed product is annealed at a temperature of 800 to 1,250° C. for 60 minutes or shorter, and further quenched.

(25) The process for preparing a nano-crystal austenite steel bulk material according to (21) or (23) above, characterized in that said quenched formed product is annealed at a temperature of 800 to 1,250° C. for 60 minutes or shorter, and further quenched.

(26) The process for preparing a nano-crystal austenite steel bulk material according to any one of (20) to (25) above, characterized in that said substance that becomes a nitrogen source is one or two or more substances selected from the group consisting of $N_2$ gas, $NH_3$ gas, iron nitride, chromium nitride, and manganese nitride.

(27) The process for preparing a nano-crystal austenite steel bulk material according to any one of (20) to (26) above, characterized in that an atmosphere in which said mechanical alloying is applied is any one gas selected from the group consisting of (1) an inert gas such as argon gas, (2) $N_2$ gas, and (3) $NH_3$ gas or a mixed gas of two or more gases selected from (1) to (3).

(28) The process for preparing a nano-crystal austenite steel bulk material according to any one of (20) to (27) above, characterized in that an atmosphere in which said mechanical alloying is applied is an atmosphere of a gas with some reducing substance such as $H_2$ gas added thereto.

(29) The process for preparing a nano-crystal austenite steel bulk material according to any one of (20) to (26) above, characterized in that an atmosphere in which said mechanical alloying is applied is a vacuum, a reducing atmosphere with some reducing substance such as $H_2$ gas added to a vacuum or a reducing atmosphere.

(30) The process for preparing a nano-crystal austenite steel bulk material according to any one of (20) to (29) above, characterized in that said respective austenite steel forming components such as iron and chromium, nickel, manganese, carbon or the like are mixed with 1 to 10% by volume of a metal nitride such as AlN, NbN, and $Cr_2N$ or 0.5 to 10% (by mass) of a nitrogen affinity metal that has a stronger chemical affinity for nitrogen than for iron, such as niobium, tantalum, manganese, chromium, tungsten, and molybdenum or cobalt together with said substance that becomes a nitrogen source, and said additive nitride is dispersed or said metal element or a nitride, carbo-nitride or the like thereof is precipitated and dispersed in a mechanical alloying (MA) process and a process of forming-by-sintering of mechanically alloyed (MA) powders, thereby obtaining a super hard and tough austenite steel bulk material having an improved corrosion resistance.

(31) The process for preparing a nano-crystal austenite steel bulk material according to any one of (20) to (30) above, characterized in that said respective austenite steel forming components such as iron and chromium, nickel, manganese, carbon or the like are mixed with 1 to 10% by volume of a grain dispersant comprising a metal or semimetal nitride such as AlN, NbN, TaN, $Si_3N_4$, and TiN together with said substance that becomes a nitrogen source, and crystal grains are more finely divided on a nano-size level in a mechanical alloying (MA) process and crystal grains are prevented from becoming coarse in a forming-by-sintering process of mechanically alloyed (MA) powders, thereby obtaining a super hard and tough austenite steel bulk material having an improved corrosion resistance.

(32) The process for preparing a nano-crystal austenite steel bulk material according to any one of (20) to (29) and (31) above, characterized in that respective fine powders of austenite steel-forming components for a high manganese-carbon steel type composed mainly of iron, manganese and carbon are mixed with fine powders of a metal nitride such as iron nitride that becomes a nitrogen source, mechanical alloying (MA) is applied to a mixture in an inert gas such as argon gas, a vacuum, a vacuum with some reducing substance such as $H_2$ gas added thereto or a reducing atmosphere, thereby preparing powers of nano-crystal austenite steel comprising 4 to 40% (by mass) of Mn, 0.1 to 5.0% (by mass) of N, 0.1 to 2.0% (by mass) of C and 3.0 to 10.0% (by mass) of Cr with the rest being substantially Fe, and forming-by-sintering treatment like hot forming-by-sintering such as sheath rolling, spark plasma sintering, and extrusion or explosive forming is applied to said powders of said austenite steel, thereby obtaining a super hard and tough austenite steel bulk material having an improved corrosion resistance.

(33) The process for preparing a nano-crystal austenite steel bulk material according to any one of (20) to (32) above, characterized in that said austenite steel-forming and blending composition comprises 12 to 30% (by mass) of Cr, 0 to 20% (by mass) of Ni, 0 to 30% (by mass) of Mn, 0.1 to 5.0% (by mass) of N and 0.02 to 1.0% (by mass) of C with the rest being substantially Fe, and said forming-by-sintering is carried out at a temperature of 600 to 1,250° C.

(34) The process for preparing a nano-crystal austenite steel bulk material according to any one of (20) to (31) above, characterized in that an amount of oxygen entrapped from a mechanical alloying vessel, hard steel balls or the like into said high-nitrogen nano-crystal austenite steel powders during mechanical alloying (MA) is adjusted to 0.01 to 1.0% (by mass), and a metal oxide or a semimetal oxide that is a compound of said oxygen is used to more finely divide crystal grains on a nano-size level in a mechanical alloying (MA) process, and prevent crystal grains from becoming coarse in a forming-by-sintering process of mechanically alloyed (MA) powders.

(35) Mechanical clamping materials such as high tensile strength bolts and nuts; bulletproof materials such as bulletproof sheets and bulletproof vests; mechanical tools and members such as dies, drills, springs and gears; artificial medical materials such as artificial bones, artificial joints and artificial dental roots; medical mechanical tools such as injection needles, surgeon's knives and catheters; die materials used in press operations such as deep drawing, powder compacting, forging, press forming, and wire drawing; hydrogen storage tanks (that make use of much better hydrogen resistance); sharp-edged tools such as kitchen knives, razors and scissors; turbine members such as turbine fins and turbine blades; defensive weapons such as fortifications, bulletproof walls, firearms and tanks; sporting materials such as skating and sledging materials; chemical plant materials such as pipes, tanks, valves and desalination equipment for seawater; chemical reaction vessels; atomic power generator materials; flying object materials such as rockets, jet planes and space stations; light-weight housing materials for personal computers and attaché cases; materials for transport systems such as automobiles, ships, linear motorcars and deep submergence vehicles; cold weather-resistant materials; ship lifts; window frames; structural materials; traps, etc., all formed of the nano-crystal austenite steel bulk material according to any one of (1) to (19) above.

According to the invention, as either mechanical milling (MM) or mechanical alloying (MA) is applied to a powdery material of a single metal, it is formed into powders having an ultra-fine crystal grain structure. By the forming-by-sintering of those powders at a temperature of nearly 900 to 1,000° C., the metal bulk material can be easily prepared.

As mechanical alloying (MA) is applied to a powdery mixture of powders of a practical single metal such as iron, cobalt, nickel, and aluminum with carbon, niobium, titanium or the like added thereto, there is obtained a more ultra-fine crystal grain structure. Such forming-by-sintering as mentioned above readily gives a bulk material having a nano-crystal grain structure, which is much higher than that obtained by melting in terms of strength and hardness.

With a magnetic element such as iron or cobalt whose crystal grain diameter is reduced by MM down to the nano-order level, the smaller the grain diameter, the higher the soft magnetism becomes.

According to the invention, as mechanical alloying (MA) is applied to an elementary powder mixture of, e.g., the chromium-nickel or chromium-manganese type comprising iron and chromium, nickel, manganese, carbon or the like while Fe—N alloy powders or the like are used as a nitrogen source material, the component elements in the raw powders are mechanically alloyed (austenitized) without recourse to any melting process, thereby obtaining austenite steel powders which have a nano-size crystal grain structure that can never be achieved by conventional processes, and which is much more reinforced through solid-solution strengthening by solid solution of nitrogen into an austenite phase. Even in the next forming-by-sintering process of the austenite steel powders, the nano-crystal structure is held substantially intact by the pinning of austenite crystal grain boundaries by some amounts of metal oxides or semimetal oxides that are present in the mechanically alloyed (MA) powders, although there is certain crystal grain growth. Thus, the synergistic effects of the solid-solution strengthening by nitrogen and the enhanced crystal grain reduction are combined with the toughness inherent in the austenite phase to make it easy to prepare a super hard, strength and tough, non-magnetic, high-nitrogen nano-crystal austenite steel (nano-crystal austenite stainless steel) material having an improved corrosion resistance (pitting corrosion resistance).

In addition, high-manganese austenite steel having a nano-crystal grain structure, too, can be easily prepared by the application of the MA and forming-by-sintering process such as one mentioned above.

EXPLANATION OF REFERENCE NUMERALS

Figure 1:
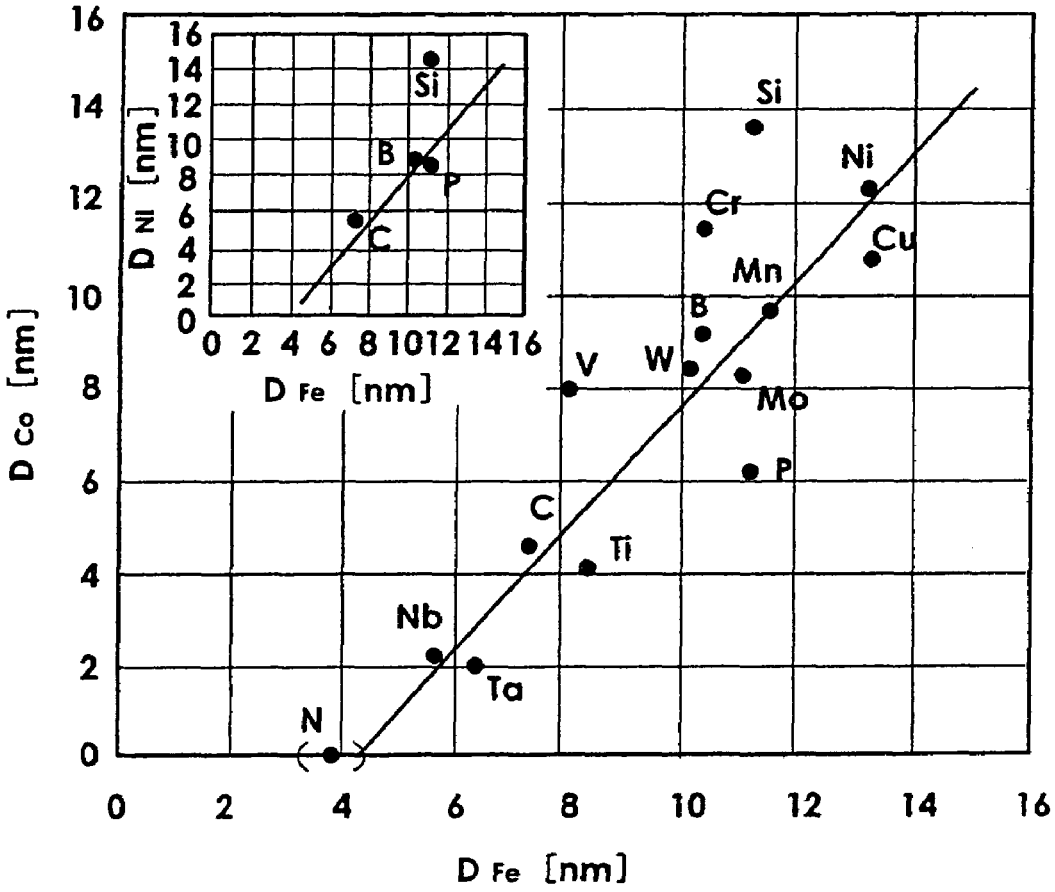
FIG. 1 is illustrative of the mean crystal grain diameters of each element upon 50-hour mechanical alloying (MA) of powders of iron, cobalt and nickel with other element (A) added thereto in an amount of 15 at %, as used in one specific example of the invention.

1: extrusion die,
2: sample,
3: dummy block,

4: vessel,
5: ram,
T: forming temperature, and
t: forming time.

BEST MODE FOR CARRYING OUT THE INVENTION

In one embodiment of the invention, mechanical alloying (MA) is applied to the fine powders of austenite steel-forming components comprising iron and chromium, nickel, manganese, carbon or the like, using a ball mill or the like at room temperature in an atmosphere of argon or other gas.

The mechanically alloyed powders are easily reduced down to a crystal grain diameter of about 15 to 25 nm by mechanical energy applied by ball milling.

Then, the thus mechanically alloyed powders are vacuum charged in a stainless steel tube (sheath) of about 7 mm in inside diameter, for forming-by-sintering by means of sheath rolling using a rolling machine at a temperature of around 800 to 1,000° C. In this way, a sheet of about 1.5 mm in thickness can be easily prepared.

Furthermore, if mechanical milling (MM) is applied to powders comprising each single element such as iron, cobalt, and nickel to obtain mechanically milled (MM) powders reduced down to nano-order ultra-fine grain diameters, it is then possible to prepare much more improved soft magnetic materials, because coercive force decreases with a grain diameter D decreasing from near critical 20 nm.

In another embodiment of the invention, mechanical alloying (MA) is applied to a powder mixture of, for instance, a chromium-nickel or chromium-manganese type material wherein elementary powders such as iron, chromium, nickel and manganese are mixed with a nitrogen (N) source such as iron nitride in such a way as to have a target composition, using a ball mill at room temperature in an atmosphere of argon or other gas.

Thereupon, the mechanically alloying (MA) powders are mechanically alloyed not by way of any melting process under mechanical energy added as by ball milling, so that they can be reduced down to a few nm to a few tens of nm ultra-fine levels, yielding high-nitrogen nano-crystal austenite steel powders of the chromium-nickel or chromium-manganese type.

Then, such austenite steel powders are vacuum charged in a stainless steel tube (sheath) of about 7 mm in inside diameter for forming-by-sintering by sheath rolling using a rolling machine at 900° C. for instance. It is thus possible to easily prepare an about 1.5 mm-thick high-nitrogen austenite steel sheet having a nano-crystal structure comprising crystal grains of about 30 to 80 nm.

If the amount of a metal or semimetal oxide form of oxygen inevitably entrapped in the powders that are undergoing mechanical alloying (MA) is usually regulated to up to about 0.5% (by mass), it is then possible to prevent coarsening of crystal grains in the forming-by-sintering process. To enhance such coarsening-prevention effects, it is desirable to add 1 to 10% by volume, especially 3 to 5% by volume of a crystal grain dispersant such as AlN, and NbN to the mechanically alloyed (MA) powders.

If mechanical alloying (MA) is applied to the above elementary powder mixture of iron and chromium, nickel, manganese, carbon or the like with the nitrogen (N) source, e.g., iron nitride and with an additive element having a greater chemical affinity for N than iron, such as niobium, tantalum, chromium, and manganese, in an amount of up to 10% (by mass), refinements of crystal grains are further promoted in the MA process. Furthermore in the forming-by-sintering process, the above additive metal element acts to increase the solubility of N in the matrix (austenite) with a marked decrease in the diffusion coefficient of N, so that if the forming-by-sintering temperature, time, etc. are regulated, it is then possible to achieve nearly complete prevention of denitrification from the matrix phase. It is to be understood that the addition of a high-melting element such as niobium or tantalum is also helpful for inhibition of coarsening of crystal gains in the forming-by-sintering process.

However, the above additive metal element other than manganese is a ferrite-stabilization element that is ineffective unless used in a range without detrimental to the stability of the austenite matrix phase.

In yet another embodiment of the invention, mechanical alloying (MA) is applied to an elementary powder mixture having a high-manganese austenite steel composition that contains manganese in an amount of about 20 to 30% (by mass) and comprises iron, manganese and carbon, using a ball mill at room temperature in an atmosphere of argon or other gas.

Thereupon, the mechanically alloyed alloy powders provide high-manganese nano-crystal austenite steel fine powders of a few nm to a few tens of nm order. As in the first and second embodiments of the invention, forming-by-sintering readily gives an about 1.5-mm thick high-manganese austenite steel having a nano-crystal grain structure of about 50 to 70 nm.

In this high-manganese steel, too, the effect of nitrogen on solid-solution hardening is much more enhanced by the incorporation of 0.1 to 5.0% (by mass) of nitrogen.

Thus, in the invention, mechanical alloying (MA) is applied to the elementary powder mixture of, for instance, the chromium-nickel or chromium-manganese type comprising iron and chromium, nickel, manganese, carbon or the like, with iron nitride powders added thereto as the nitrogen (N) source substance for mechanical alloying (austenitization) of the component elements in the starting powder mixture, thereby preparing a high-nitrogen-concentration austenite steel powders which have a nano-size crystal grain structure and a much greater solid-solution strengthening by way of solid solution of nitrogen into the austenite phase. As the austenite steel powders are consolidated by sintering such as sheath rolling or extrusion, the amount of a metal or semimetal oxide form of oxygen that is inevitably formed during the mechanical alloying (MA) process is regulated to up to about 0.5% (by mass), so that any coarsening of crystal grains is held back by the pinning effect of that oxide on crystal grain boundaries. It is thus possible to achieve effective preparation of high-nitrogen-concentration nano-crystal austenite steel bulk materials.

It is also possible to achieve more effective preparation of high-manganese austenite steel having a nano-crystal grain structure by the application of the same MA/forming-by-sintering technique as mentioned above.

EXAMPLES

Examples of the invention are now explained with reference to the accompanying drawings.

Example 1

FIG. 1 is illustrative of changes in the mean crystal grain diameter of each mechanically alloyed element, that is, iron, cobalt and nickel when a 50-hour mechanical alloying (MA) was applied to an elementary powder mixture having an $M_{85}A_{15}$ (at %) (M is iron, cobalt or nickel), which comprised powders of the elements iron, cobalt and nickel with the addition thereto of 15 at % of carbon (C), niobium (Nb), tantalum (Ta), titanium (Ti), phosphor (P), boron (B) and so on as other elements (A). It is here noted that the data about nitrogen N are directed to iron alone.

In FIG. 1, $D_{Fe}$, $D_{Co}$ and $D_{Ni}$ are the mean crystal grain diameter (nm) of the mechanically alloyed iron, cobalt, and nickel, respectively. From FIG. 1, it has been found that the reduction of crystal grain diameters of each of the elements iron, cobalt and nickel can be more effectively promoted by mechanical alloying with the addition thereto of carbon, niobium, tantalum, titanium and so on, all the three elements being reduced down to grain diameters of a few nano-orders.

It has also been found that the refinement of crystal grains of copper, aluminum, and titanium, too, is promoted by the addition thereto of other elements, and that carbon, phosphor and boron are particularly effective as the additive elements in this case.

Example 2

Figure 2:
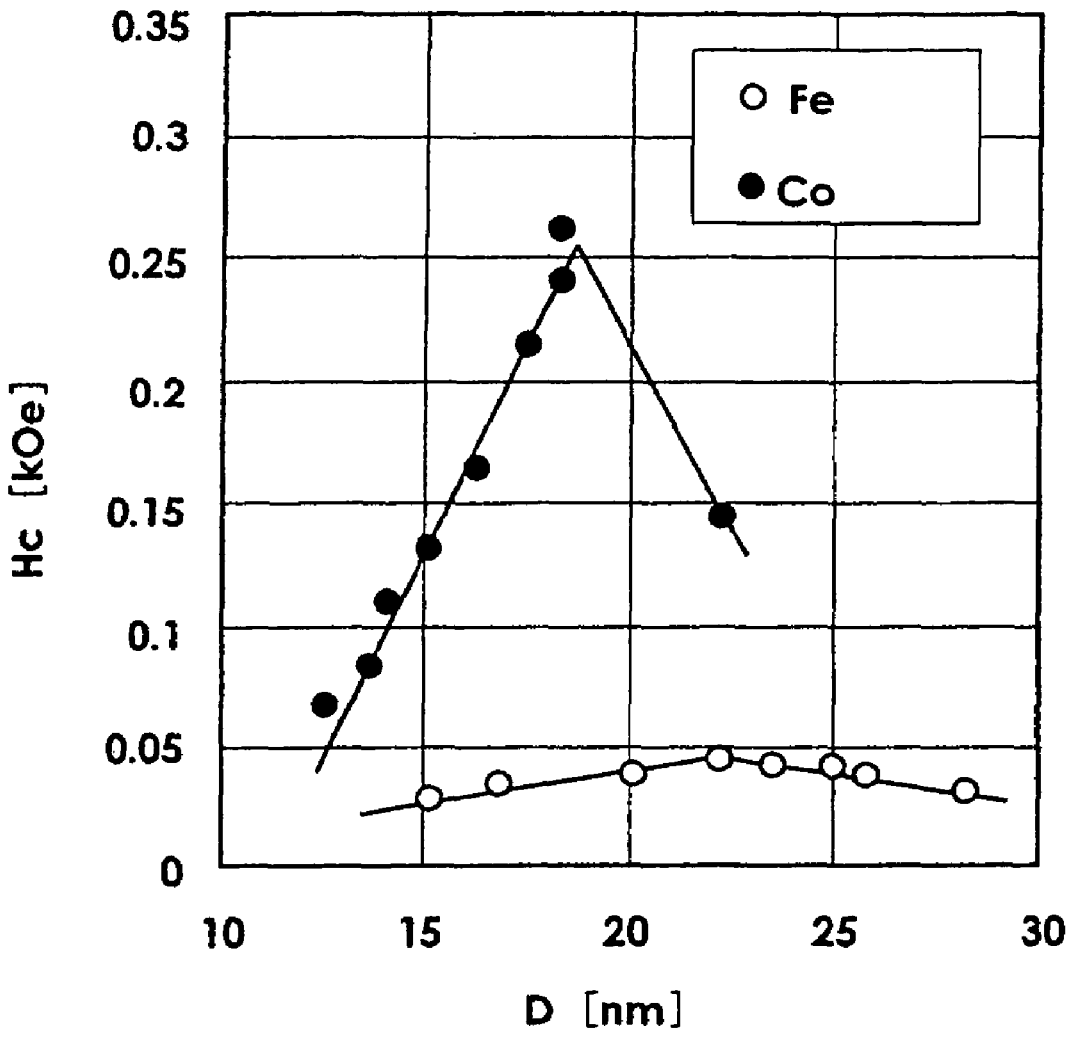
FIG. 2 is illustrative of changes in coercive force Hc (kOe) depending on the mean crystal grain diameter D of iron, and cobalt treated by mechanical milling (MM), as used in one specific sample of the invention.

FIG. 2 is illustrative of the relationships between the mean crystal grain diameter D (nm) and the coercive force Hc (kOe) of mechanically milled (MM) iron, and cobalt.

From FIG. 2, it has been found that both iron and cobalt decrease in coercive force Hc as D decreases from a critical grain diameter D of around 20 nm, resulting in improvements in soft magnetism.

Example 3

Figure 3:
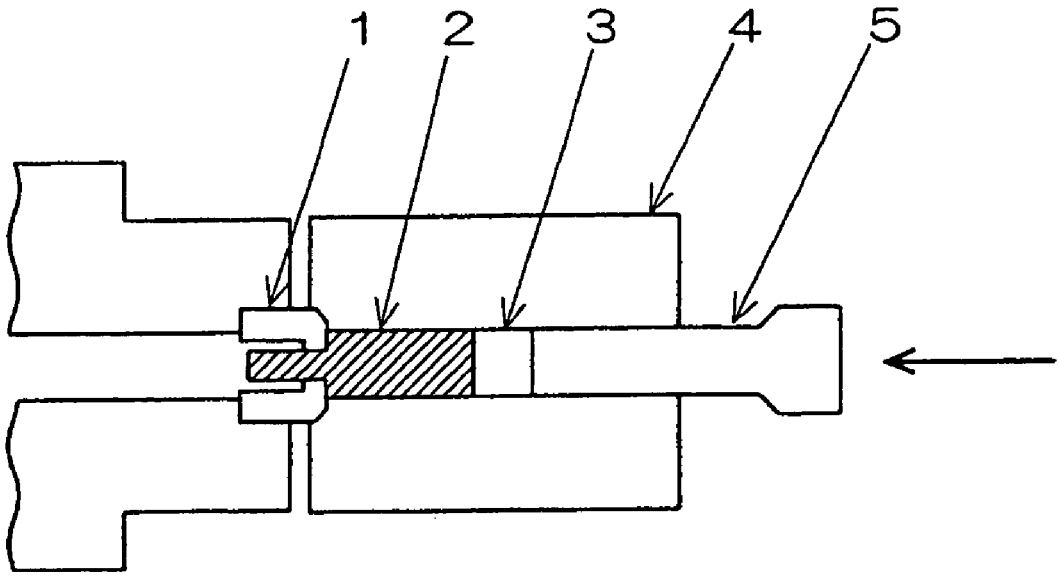
FIG. 3 is illustrative of extrusion of a powder sample as used in one specific example of the invention.

FIG. 3 is illustrative of the results of a 1,000° C.-extrusion (at a pressure of 98 MPa) of powder samples (a) and (b), each of TiC alone.

From a comparison of sample (a) to which 100-hour mechanically milling (MM) was applied with sample (b) to which no MM was applied, it has been found that a portion of the sample (a) extruded out of an die aperture has a length of about 12 mm whereas that of sample (b) has a length of about 1 to 2 mm. Such differences in forming behavior between both samples would be probably due to the superplasticity of sample (a) whose crystal grains are reduced down to the ultra-fine level by mechanical milling (MM).

Example 4

Figure 4:
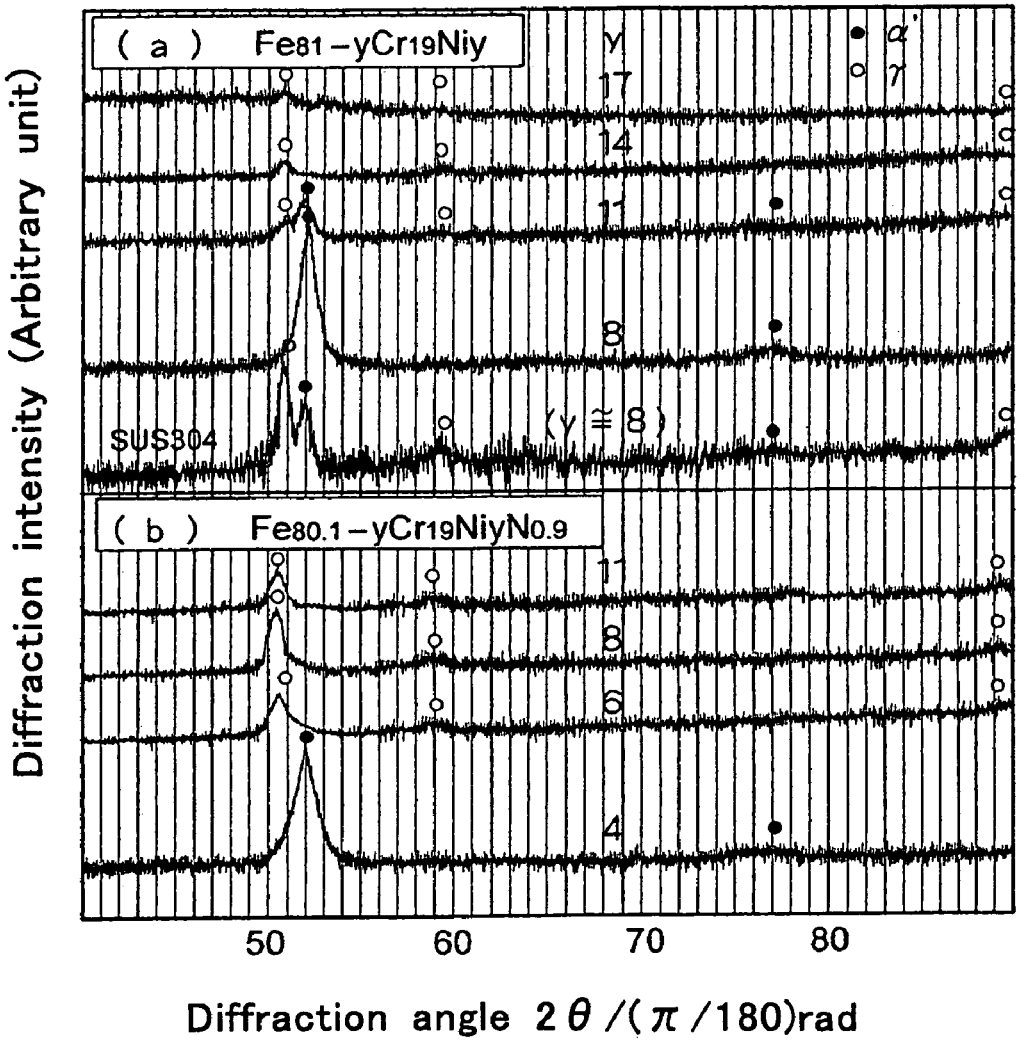
FIG. 4 is an X-ray diffraction (XRD) diagram for mechanically alloyed (MA) powders as used in one specific example of the invention.

FIG. 4 is illustrative of the results of examination of the phases formed in two powder samples by X-ray diffraction (XRD: cobalt Kα radiation having a wavelength λ of 0.179021 nm) after mechanical alloying (MA). Specifically, mechanical alloying (MA) was applied to chromium-nickel based powder samples (a) $Fe_{81-y}Cr_{19}Ni_y$ (% by mass) where y=8 to 17 and (b) $Fe_{80.1-y}Cr_{19}Ni_yN_{0.9}$ (% by mass) where y=4 to 11, in which elementary powders of Fe, Cr and Ni were blended together Fe—N alloy (containing 5.85% by mass of N) powders in such a way as to have a target composition). Sample (a) and (b) were each charged in a hard steel, cylindrical sample vessel of 75 mm in inside diameter and 90 mm in height for mechanical alloying for 720 ks (200 hours), using a conventional planetary ball mill (having four sample vessels attached thereto) at room temperature. More specifically, the sample vessel was rotated at 385 rpm, the total mass of the sample was 100 grams (25 grams per each sample vessel), and the ratio of the mass of chromium steel balls to the mass of the powder sample was 11.27:1.

In FIG. 4, ○ indicates that the formed phase is of austenite (γ), and ● indicates that the formed phase is of martensite (α') induced by strong processing in the MA process.

From FIG. 4, it has been seen that in order for the nitrogen-free sample (a) to have a single austenite phase, the content of nickel (y) must be greater that 14% (by mass) (see FIG. 4(*a*)); however, the addition of 0.9% (by mass) of nitrogen (N) allows the formed phase to consist nearly of austenite when the content of nickel is greater than 6% (by mass). This shows that austenitization is significantly accelerated (see FIG. 4(*b*), making it possible to considerably reduce the amount of costly nickel used to compose the mechanically alloyed (MA) product of a single austenite phase.

Figure 5:
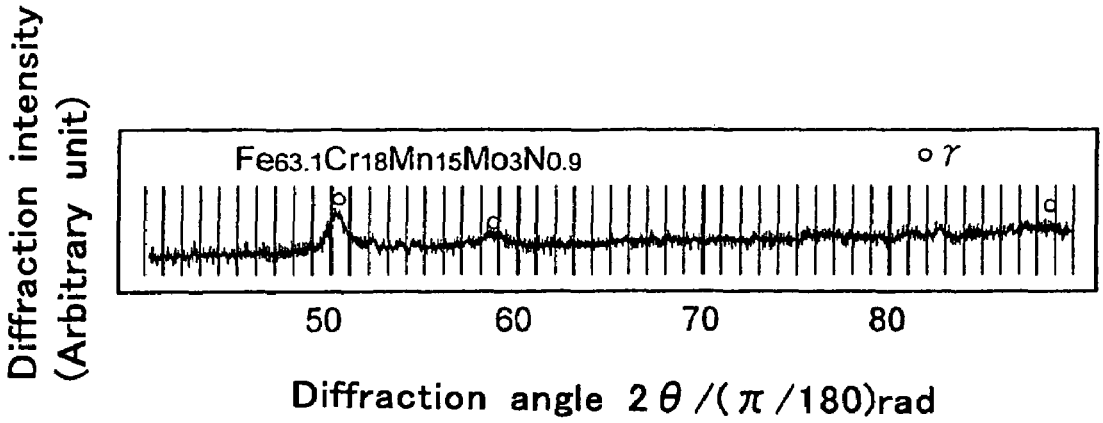
FIG. 5 is an XRD diagram for mechanically alloyed (MA) powders as used in one specific example of the invention.

FIG. 5 is illustrative of the effect of nitrogen on the austenite of a mechanically alloyed (MA) sample. To this end, mechanical alloying (MA) was applied to a $Fe_{63.1}Cr_{18}Mn_{15}Mo_3N_{0.9}$ (% by mass) sample of the chromium-manganese type under the same conditions for the chromium-nickel type sample (FIG. 4) (MA time: 200 hours, and X-ray: cobalt Kα radiation having a wavelength λ of 0.179021 nm).

A mechanically alloyed (MA) sample that was identified by X-ray diffraction (XRD) as being of austenite (γ) as shown by ○ was also measured regarding its magnetism (non-magnetism that the austenite phase shows). The results are plotted in FIG. 6.

Figure 6:
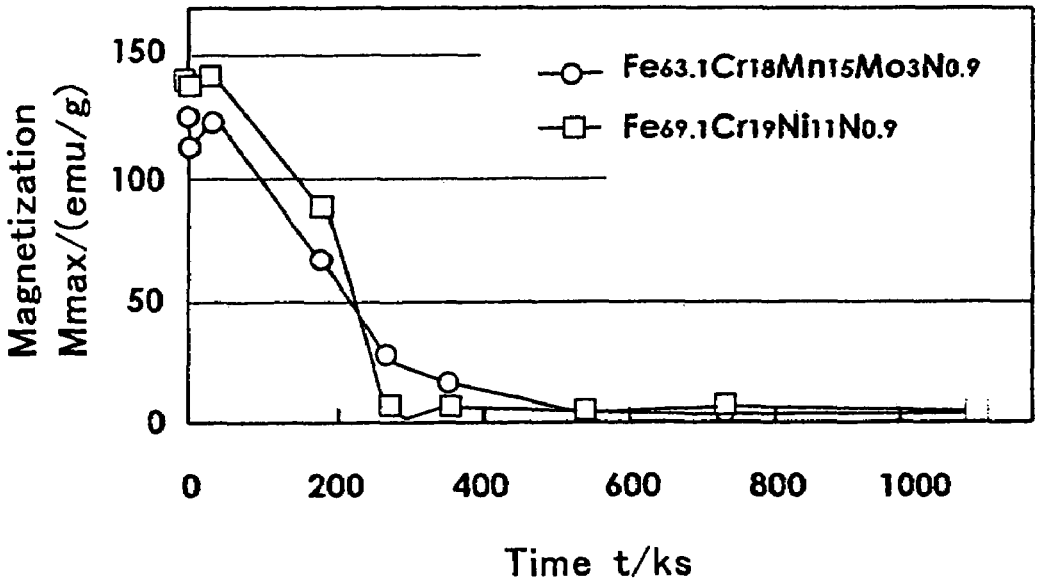
FIG. 6 is illustrative of the austenitization (non-magnetization) of mechanically alloyed (MA) powders as used in one specific example of the invention in terms of changes in magnetization Mmax (emu/g) with mechanical alloying (MA) time (t).

In FIG. 6, the magnetization measurements Mmax at room temperature of both mechanically alloyed (MA) samples of $Fe_{69.1}Cr_{19}Ni_{11}N_{0.9}$ and $Fe_{63.1}Cr_{18}Mn_{15}Mo_3N_{0.9}$ (% by mass) as obtained using a vibration sample type magnetism analyzer (VSM) are plotted as a function of mechanical alloying (MA) times t (ks) (at a magnetic field of 15 kOe).

From FIG. 6, it has been seen that both mechanically alloyed (MA) samples become austenite (non-magnetism) as Mmax drops drastically at or near the t value of 450 ks (150 hours).

Example 4 and FIGS. 4 and 5 teach that to prepare high-nitrogen austenite steel powders having a nitrogen concentration of about 0.9% by mass according to the invention, mechanical alloying (MA) should be applied for 50 to 200 hours to a powder mixture obtained by mixing iron and chromium, nickel, manganese or the like together with Fe—N alloy powders as the nitrogen source substance.

While the amount of the Fe—N alloy powders is increased, it is also possible to easily prepare high-nitrogen austenite steel powders having a nitrogen concentration of about 5% by mass according to the present process.

It is noted that samples identified by XRD and VSM as being of a single phase of austenite were used as mechanically alloyed (MA) samples for forming-by-sintering in Examples 5 to 16, given below.

Example 5

Figure 7:
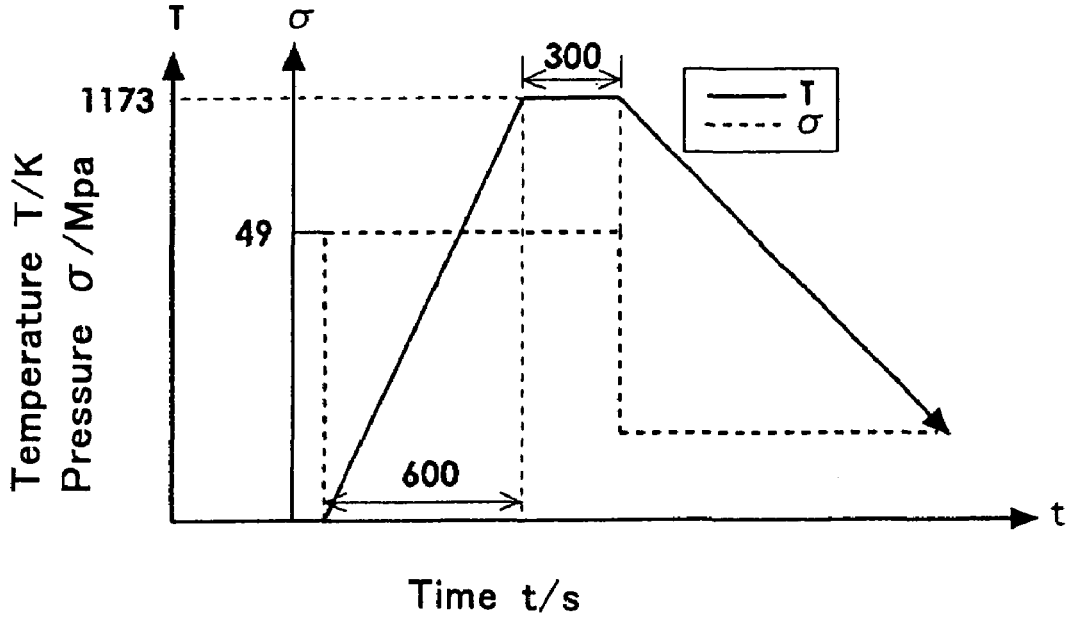
FIG. 7 is illustrative of a forming-by-sintering process using spark plasma sintering (SPS), as applied in one specific example of the invention.

FIG. 7 is illustrative of an exemplary forming-by-sintering process of mechanically alloyed (MA) samples obtained using a general-purpose spark plasma sintering (SPS) machine with a powder source of DC3±1 V, 2,600±100 A).

About 3 to 5 grams of a mechanically alloyed (MA) powder sample were charged in a graphite die of 10 mm in inside diameter, 40 mm in outside diameter and 40 mm in height in such a way as to result in a disk form of formed product of 10 mm in diameter and about 5 mm in thickness. Then, a forming pressure (σ) of 49 MPa was applied to the die from both above and below for forming-by-sintering in a vacuum. The forming-by-sintering temperature (T) was set between 650° C. and 1,000° C. (923° K. and 1,2730° K.), and the holding time at each forming temperature was 300 seconds (5 minutes).

Example 6

Figure 8:
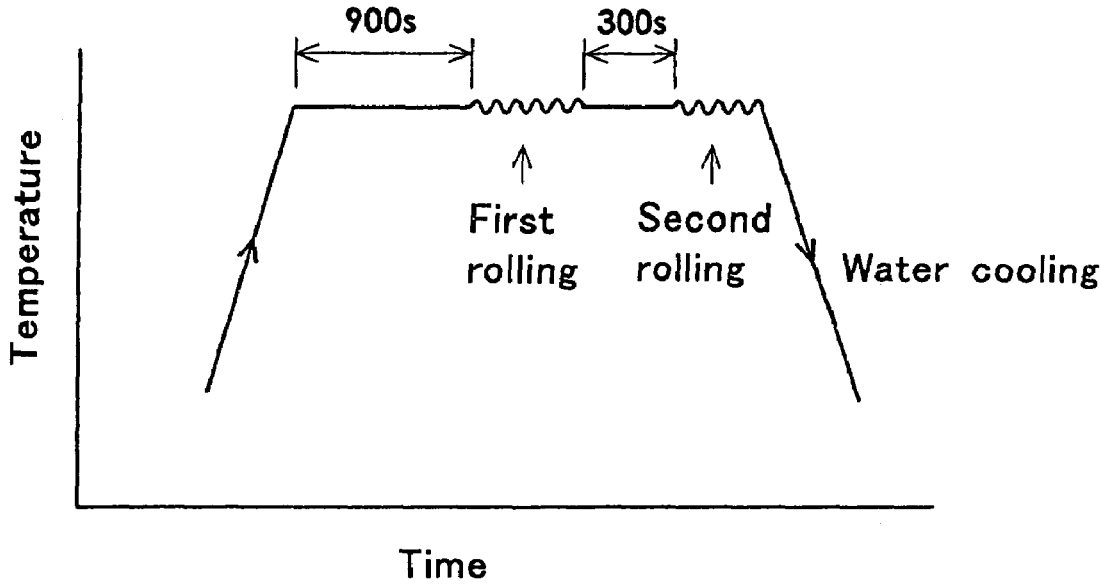
FIG. 8 is illustrative of a forming-by-sintering process using sheath rolling (SR), as applied in one specific example of the invention.

FIG. 8 is illustrative of an exemplary forming-by-sintering process of mechanically alloyed (MA) powders by sheath rolling, SR.

About 10 grams of mechanically alloyed (MA) powders were charged in a vacuum in a SUS 316 stainless steel tube (sheath) of about 7 mm in inside diameter for forming-by-sintering at a temperature (T) of 650 to 1,000° C. using a rolling machine.

It is here noted that:

The sheath rolling temperature was 650 to 1,000° C., the rolling temperature holding time set before the first rolling was 900 seconds (15 minutes), and the rolling temperature holding time set before the second rolling was 300 seconds (5 minutes).

Example 7

Figure 9:
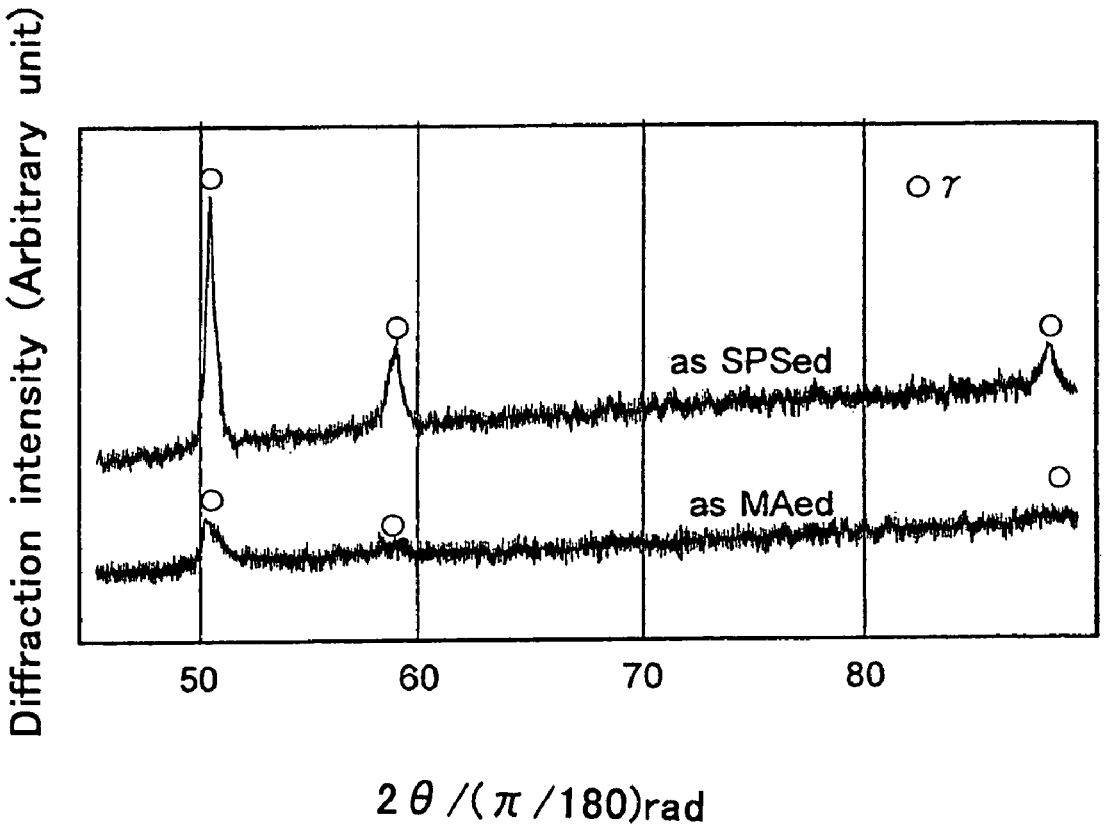
FIG. 9 is an XRD diagram for an MA sample before and after SPS forming-by-sintering at 900° C., as used in one specific example of the invention.

FIG. 9 is an XRD (X-ray: cobalt Kα radiation having a wavelength λ of 0.179021 nm) pattern for an mechanically alloyed $Fe_{60.55}Cr_{18}Mn_{18}Mo_3N_{0.45}$ (% by mass) sample before and after SPS forming at 900° C., showing that even after SPS forming, that sample still takes on a single phase of austenite (γ). In FIG. 9, "as MAed" and "as SPSed" stand for before SPS forming and after SPS forming, respectively.

Figure 10:
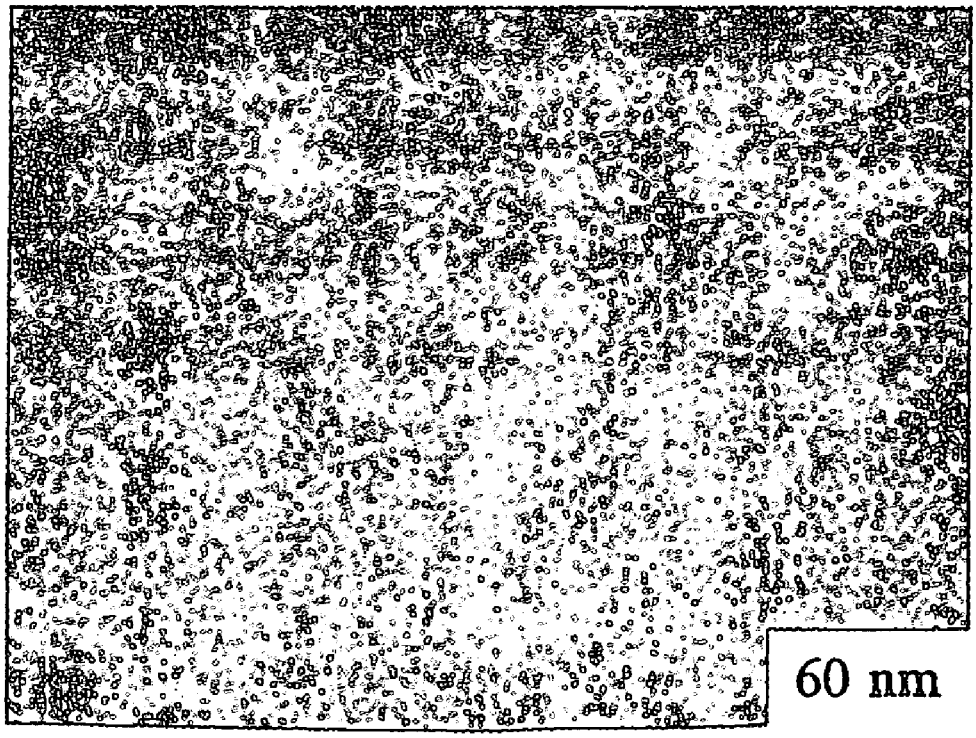
FIG. 10 is a SEM photograph illustrative in section of an MA sample (of about 5 mm in thickness) that was obtained by SPS forming at 900° C., as used in one specific example of the invention.

FIG. 10 is a scanning electron microscope (SEM) photograph of a section of the SPS formed sample product.

The mean crystal grain diameters (D) of the mechanically alloyed (MA) $Fe_{60.55}Cr_{18}Mn_{18}Mo_3N_{0.45}$ (% by mass) sample before and after SPS forming at 900° C. are shown in Table 1.

TABLE 1

Mean Crystal Grain Diameter (D) of mechanically alloyed (MA) $Fe_{60.55}Cr_{18}Mn_{18}Mo_3N_{0.45}$ (% by mass) sample before and after SPS forming at 900° C.

| Crystal Grain Diameter, nm | Before SPS forming (as MAed) | After SPS Forming (as SPSed) |
|---|---|---|
| D | 12 | 45 |

In Table 1, the value of D was calculated from the X-ray pattern of FIG. 9, using Scherrer's equation. The value found after forming corresponds nearly to the grain diameter observed from the SEM pattern of FIG. 10.

Example 7, FIG. 9 and Table 1 teach that according to the invention, the nano-structure can be maintained even after forming, although some crystal grain growth is found in the SPS forming-by-sintering process.

Example 8

Figure 11:
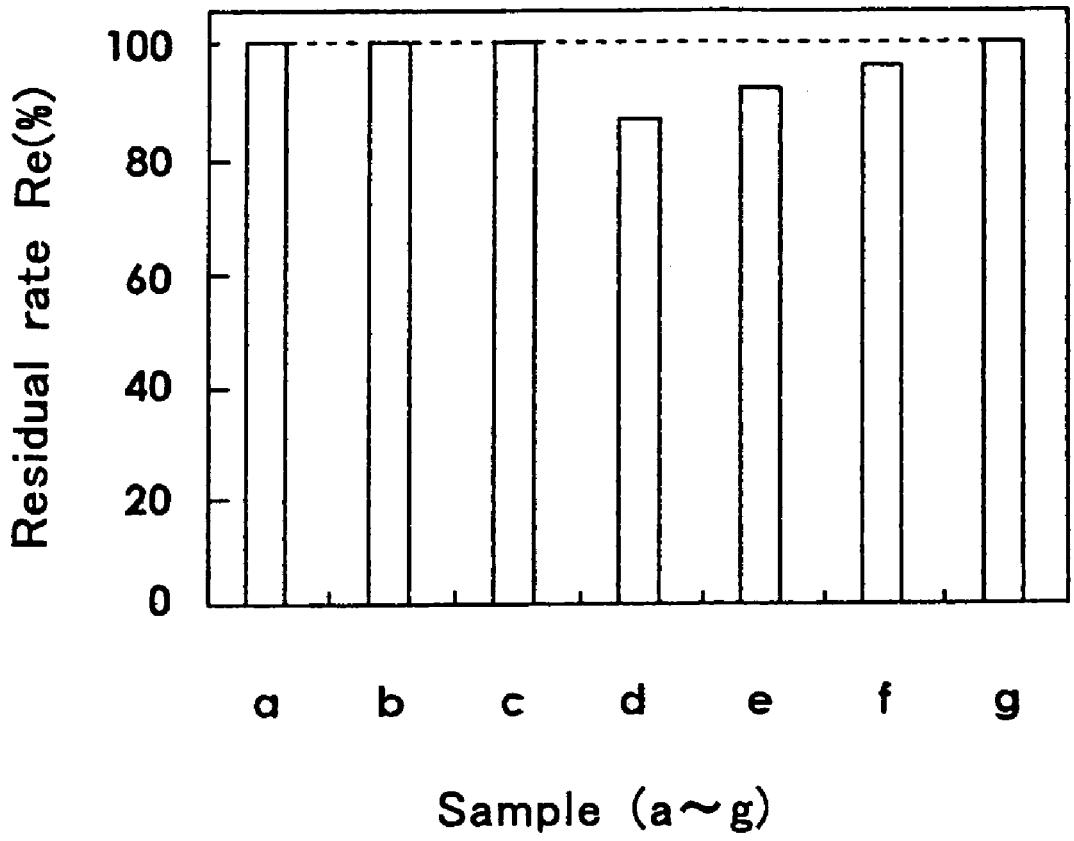
FIG. 11 is a graph indicative of the residual rate Re (%) of nitrogen in an MA sampled obtained by SPS forming at 900° C., as used in one specific example of the invention.

FIG. 11 is indicative in graph of the residual rate Re (%) of nitrogen after forming regarding products obtained by forming at 900° C. of the following various mechanically alloyed (MA) powder samples (a) through (g).

(a) $Fe_{60.55}Cr_{18}Mn_{18}Mo_3N_{0.45}$ (% by mass), (b) $Fe_{60.6}Cr_{18}Mn_{17.5}Mo_3N_{0.9}$ (% by mass), (c) $Fe_{63.1}Cr_{18}Mn_{15}Mo_3N_{0.9}$(% by mass), (d) $Fe_{72.1}Cr_{19}Ni_8N_{0.9}$ (% by mass), (e) $Fe_{67.1}Cr_{19}Ni_8Mn_5NO_{0.9}$ (% by mass), (f) $Fe_{68.1}Cr_{23}Ni_8N_{0.9}$ (% by mass), and (g) $Fe_{64.1}Cr_{20}Ni_8Mn_5Nb_2N_{0.9}$ (% by mass).

Re (%): (Ns/Nm)×100 where Nm is the content of nitrogen in the as-mechanically alloyed sample (% by mass), and Ns is the content of nitrogen in the sample after SPS forming.

From FIG. 11, it has been seen that the samples (a), (b) and (c) of the chromium-manganese type have a Re value of 100% whereas the chromium-nickel type sample (d) (high-nitrogen stainless steel having a composition equivalent to SUS 304 steel) has an Re value of about 85%, indicating that about 15% of nitrogen contained in the mechanically alloyed (MA) sample are dissipated off in the SPS forming process. However, the residual rate Re is significantly improved in the case of sample (e) where manganese is added to sample (d), and sample (f) where the amount of chromium is increased. With the combined addition of elements manganese, chromium and niobium that serve to increase Re, as is the case with sample (g), Re could be brought up to 100%, indicating that denitrification in the forming process could be perfectly held back.

Figure 12:
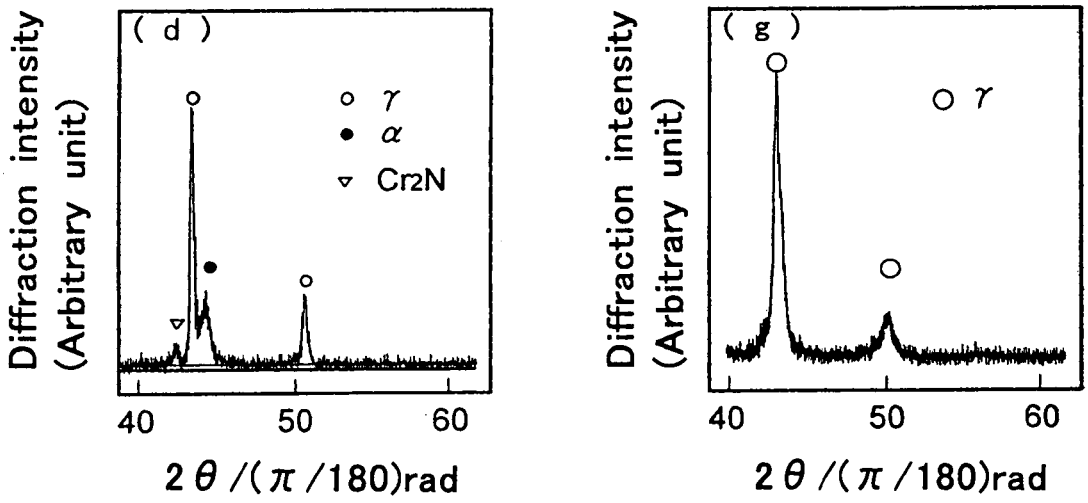
FIG. 12 is an XRD diagram for an MA sample obtained by SPS forming at 900° C., as used in one specific example of the invention.

FIG. 12 shows the results of X-ray diffraction of SPS formed samples (d) and (g) of FIG. 11 (X-ray: copper Kα radiation having a wavelength λ of 0.154051 nm). From this, it has been seen that sample (d) has a structure with ferrite (α) and $Cr_2N$ phases precipitated by SPS forming in an austenite (γ) phase, whereas sample (g) keeps its single phase structure of austenite intact even after SPS forming.

Example 9

Set out in Table 2 are the mean crystal grain diameter D, Vickers hardness Hv, offset yield strength σ0.2, tensile strength σB, elongation δ and oxygen and nitrogen values upon analysis of an SPS or SR formed product at a forming-by-sintering temperature of 900° C. of a mechanically alloyed (MA) $Fe_{64.1}Cr_{20}Ni_8Mn_5Nb_2N_{0.9}$ (% by mass) sample as well as a test piece (SR plus annealed piece) obtained by SR forming plus annealing (at 1,150° C. for 15 minutes).

TABLE 2

Mean crystal grain diameter D, Vickers hardness Hv, offset yield strength σ0.2, tensile strength σB, elongation δ and oxygen and nitrogen values upon analysis of an SPS or SR formed product (at a forming-by-sintering temperature of 900° C. of a mechanically alloyed (MA) $Fe_{64.1}Cr_{20}Ni_8Mn_5Nb_2N_{0.9}$ (% by mass) sample as well as a test piece (SR plus annealed piece) obtained by SR forming plus annealing (at 1,150° C. for 15 minutes)

| Sample | D nm | Hv | σ0.2 MPa | σB MPa | δ % | O | N |
|---|---|---|---|---|---|---|---|
| SPS Piece* | 27 | 690 | — | — | — | 0.582 | 0.892 |
| SR Piece** | 29 | 750 | 1,450 | 2,810 | 4 | 0.591 | 0.887 |
| SR Piece*** | 35 | 745 | 1,400 | 2,640 | 3 | 0.477 | 0.902 |
| SR + Annealed Piece | 98 | 670 | 1,600 | 2,850 | 30 | 0.594 | 0.898 |
| SUS 304 Steel | 75,000 | 160 | 280 | 590 | >40 | — | — |

O (oxygen), and N (nitrogen) was given in % by mass, and SUS 304 steel sheet was a material obtained by solid-solution treatment.
The values of D were calculated using Scherrer's equation.
*10 mm in diameter, and 5 mm in thickness.
**The tensile testing piece had a gage size of 4.5 mm in width, 12 mm in length (gage point distance) and 1.3 mm in thickness.
***SR forming of austenite steel powders that were mechanically alloyed for 250 hours in a nitrogen gas atmosphere.

Example 10

Set out in Table 3 are the mean crystal grain diameter D, Vickers hardness Hv, offset yield strength σ0.2, tensile strength σB, elongation δ and oxygen and nitrogen values upon analysis of products formed by way of SR forming and SR forming plus annealing of mechanical alloying (MA) samples of (a) $Fe_{63.1}Cr_{18}Mn_{15}Mo_3N_{0.9}$ (% by mass) and (b) $Fe_{65.55}Cr_{25}Ni_5Mo_4N_{0.45}$ (% by mass) (the SR forming temperature: 900° C., the annealing temperature 1,150° C., and the annealing temperature holding time: 15 minutes). It is here noted that (a) and (b) are an austenite steel sample and an austenite•ferrite steel sample, respectively.

TABLE 3

Mean crystal grain diameter D, Vickers hardness Hv, offset yield strength σ0.2, tensile strength σB, elongation δ and oxygen and nitrogen values upon analysis of products formed by way of SR forming and SR forming plus annealing of mechanical alloying (MA) samples of (a) $Fe_{63.1}Cr_{18}Mn_{15}Mo_3N_{0.9}$ (% by mass) and (b) $Fe_{65.55}Cr_{25}Ni_5Mo_4N_{0.45}$ (% by mass) (the SR forming temperature: 900° C., the annealing temperature 1,150° C., and the annealing temperature holding time: 15 minutes).

| Sample | Forming-by-Sintering | D Nm | Hv | σ0.2 MPa | σB MPa | δ % | oxygen % by mass | nitrogen % by mass |
|---|---|---|---|---|---|---|---|---|
| a | SR | 110 | 830 | 1,510 | 2,680 | 3 | 0.598 | 0.902 |
| | SR plus Annealing | 153 | 760 | 1,560 | 2,790 | 24 | 0.604 | 0.846 |
| b | SR | 82 | 850 | 1,450 | 2,820 | 2 | 0.443 | 0.453 |
| | SR plus Annealing | 90 | 810 | 1,600 | 2,940 | 20 | 0.448 | 0.449 |

a: austenite steel sample
b: austenite · ferrite steel sample

Example 11

Set out in Table 4 are the mean crystal grain diameter D, Vickers hardness Hv, offset yield strength σ0.2, tensile strength σB, elongation δ and oxygen and nitrogen values upon analysis of test pieces obtained at a forming-by-sintering temperature of 900° C. from mechanical alloying (MA) samples of (a) $Fe_{69.2}Mn_{30}C_{0.8}$ (% by mass), (b) $Fe_{64.1}Mn_{30}Cr_5C_{0.8}N_{0.1}$ (% by mass) and (c) $Fe_{64.2}Mn_{30}Al_5C_{0.8}$ (% by mass) by way of SR forming and SR forming plus annealing (at 1,150° C. for 15 minutes)

TABLE 4

Mean crystal grain diameter D, Vickers hardness Hv, offset yield strength σ0.2, tensile strength σB, elongation δ and oxygen and nitrogen values upon analysis of test pieces obtained at a forming-by-sintering temperature of 900° C. from mechanical alloying (MA) samples of (a) $Fe_{69.2}Mn_{30}C_{0.8}$ (% by mass), (b) $Fe_{64.1}Mn_{30}Cr_5C_{0.8}N_{0.1}$ (% by mass) and (c) $Fe_{64.2}Mn_{30}Al_5C_{0.8}$ (% by mass) by way of SR forming and SR forming plus annealing (at 1,150° C. for 15 minutes)

| Sample* | Forming-by-Sintering | D nm | Hv | σ0.2 MPa | σB MPa | δ % | oxygen % by mass | nitrogen % by mass |
|---|---|---|---|---|---|---|---|---|
| a | SR | 14 | 690 | 1,530 | 2,520 | 4 | 0.603 | — |
| b | SR | 10 | 810 | 1,640 | 2,960 | 3 | 0.594 | 0.101 |
| | SR plus Annealing | 105 | 705 | 1,800 | 2,870 | 26 | 0.589 | 0.103 |
| c | SR | 13 | 740 | 1,600 | 2,630 | 5 | 0.598 | — |

*1.3 mm-thick sheet

From Example 9 and Table 2, it has been found that according to the invention, when the high-nitrogen nano-crystal austenite steel (the nitrogen concentration: 0.9% by mass) having a composition equivalent to SUS 304 is formed by sintering by means of sheath rolling (SR), a hardness about four times (that exceed the hardness of the martensite structure of high-carbon steel) and offset yield strength about six times (that are comparable to that of ultra-high tensile strength steel) as high as those of SUS 304 stainless steel prepared by melting can be obtained, and additional annealing can yield a product that has an even more improved elongation.

From Table 2, it has been found that even when $N_2$ gas is used as the nitrogen gas for MA, a formed-by-sintering product can be prepared, which has tensile properties much the same as those obtained using iron nitride.

From Example 10 and Table 3 (the results of sample (a)), it has turned out that even with the $Fe_{63.1}Cr_{18}Mn_{15}Mo_3N_{0.9}$ (% by mass) material of the high-nitrogen Cr—Mn type, a material that has high strength yet enriched ductility can be prepared by SR forming plus annealing, as is the case with the material of the high-nitrogen Cr—Ni type set out in Table 2.

From Table 3 (the results of sample (b)), it has been found that the austenite·ferrite material (with a ferrite phase of about 40%), because of noticeable inhibition of crystal grain growth in the SR forming process, can have mechanical properties such as hardness and strength (σ0.2 and σB) nearly comparable to those of austenitic materials.

From Example 11 and Table 4, it has been found that even the formed-by-sintering products obtained from the $Fe_{69.2}Mn_{30}C_{0.8}$ (% by mass), $Fe_{64.1}Mn_{30}Cr_5C_{0.8}N_{0.1}$ (% by mass) and $Fe_{64.2}Mn_{30}Al_5C_{0.8}$ (% by mass) of the high manganese-carbon type can have a hardness about four times as high as that of high-manganese austenite steel prepared by melting (e.g., SCMnH3 steel comprising 11 to 14% by mass of Mn and 0.9 to 1.2% by mass of C with water quenching applied thereto from 1,000° C.), and high strength as well as enhanced ductility.

Example 12

SPS forming, extrusion, forging, high isostatic press sintering (HIP) or hot pressing at 900° C. or cold pressing at ordinary temperature was applied to an $Fe_{64.1}Cr_{20}Ni_8Mn_5Nb_2N_{0.9}$ (% by mass) mechanical alloying (MA) powder sample, followed by hot rolling at 900° C., then annealing at 1,150° C. for 15 minutes, and finally quenching in water. Set out in Table 5 are the mean crystal grain diameter D, Vickers hardness Hv, offset yield strength σ0.2, tensile strength σB, elongation δ and Charpy impact value E of the samples (a) to (g) obtained by forming-by-sintering in this manner.

It is here noted that the forming-by-sintering steps were all performed in a vacuum atmosphere saving the rolling step of sample (b), and that JIS No. 6 test pieces (5 mm in width and 2 mm in thickness) were used for tensile testing while V-notched test pieces (of 5 mm in width, 5 mm in height and 55 mm in length) was used for Charpy impact testing.

TABLE 5

Mean crystal grain diameter D, Vickers hardness Hv, offset yield strength σ0.2, tensile strength σB, elongation δ and Charpy impact value E of formed bulk samples (a) to (g) obtained by the application of various forming-by-sintering steps to the $Fe_{64.1}Cr_{20}Ni_8Mn_5Nb_2N_{0.9}$ (% by mass) mechanical alloying (MA) powder sample

| Sample | Forming-by-Sintering | D nm | HV | σ2.0 MPa | σB MPa | δ % | E $MJ/m^2$ |
|---|---|---|---|---|---|---|---|
| a | SPS + Rolling + Annealing | 105 | 690 | 1,650 | 2,890 | 32 | 2.0 |
| b | SPS + Rolling* + Annealing | 93 | 670 | 1,050 | 1,360 | 18 | 1.0 |
| c | EX + Rolling + Annealing | 152 | 620 | 1,870 | 3,040 | 35 | 2.8 |

TABLE 5-continued

Mean crystal grain diameter D, Vickers hardness Hv, offset yield strength σ0.2, tensile strength σB, elongation δ and Charpy impact value E of formed bulk samples (a) to (g) obtained by the application of various forming-by-sintering steps to the $Fe_{64.1}Cr_{20}Ni_8Mn_5Nb_2N_{0.9}$ (% by mass) mechanical alloying (MA) powder sample

| Sample | Forming-by-Sintering | D nm | HV | σ2.0 MPa | σB MPa | δ % | E MJ/m² |
|---|---|---|---|---|---|---|---|
| d | FG + Rolling + Annealing | 168 | 610 | 1,790 | 2,830 | 29 | 2.5 |
| e | HIP + Rolling + Annealing | 210 | 540 | 1,520 | 2,050 | 34 | 1.4 |
| f | HP + Rolling + Annealing | 96 | 580 | 1,440 | 1,980 | 20 | 1.7 |
| g | CP + Rolling + Annealing | 70 | 600 | 1,020 | 1,200 | 17 | 0.8 |

EX: extrusion
FG: forging
HP: hot pressing
CP: cold pressing
*Rolling atmosphere: air
SPS: pressure of 49 MPa
HIP: pressure of 50 MPa
Extrusion: extrusion ratio of 3
Hot pressing: pressure of 60 MPa
Forging: forging ratio of 2
Cold pressing: pressure of 650 MPa From a comparison of Example 12 and the results of sample (a) in Table 5 with Example 9 and the results of the material obtained by "SR plus annealing" in Table 2, it has been found that an additional application of rolling to the SPS formed product contributes to some considerable improvement in mechanical properties, and to higher toughness (a higher impact value) as well; the effect of rolling is evident.

That effect of rolling is much more noticeable as a shear-deformation inducing forming process such as extrusion and forging is applied to samples like samples (c) and (d) in Table 5 prior to rolling.

From Example 12 and Table 5, it has been found that even with the application of such forming-by-sintering processes as set out in Table 5, the crystal structure of the resulting product remains limited to the nano-size level of about 90 to 200 nm, and that with the application of the forming-by-sintering used with samples (c) and (d) in particular, tough nano-crystal austenite steel bulk materials having a high nitrogen concentration and high hardness and strength can be easily prepared.

Example 13

Figure 13:
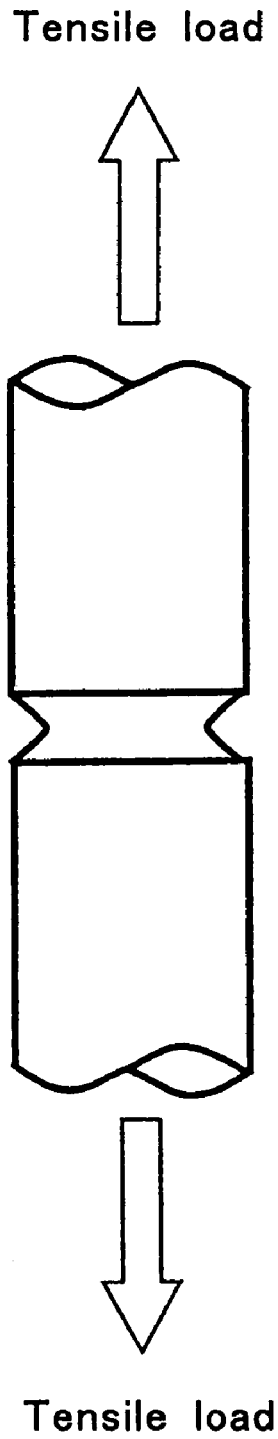
FIG. 13 is illustrative in perspective of a columnar test piece having an annular cutout in the center, used in delayed fracture testing.

FIG. 13 is illustrative in perspective of a 5 mm-diameter cylindrical test member having an annular cutout in the center, used for the following delayed fracture testing. That testing was carried out while tensile loads were continuously applied to the test member from both ends.

More specifically, the above test member was obtained by applying extrusion to an $Fe_{64.1}Cr_{20}Ni_8Mn_5Nb_2N_{0.9}$ (% by mass) mechanical alloying (MA) sample at 900° C., and then applying annealing of 1,150° C.×15 minutes/water quenching to the resulting extruded product. This test member was then found to have an offset yield strength σ0.2 of 1,690 MPa, a tensile strength σB of 2,880 MPa and an elongation δ of 34%.

In the present testing, tensile loads of 1,600 MPa were applied to the test member in water (23° C.) continuously over a time period of 100 hours. Yet, there was no delayed fracture at all.

Example 14

The relationships between the concentration (content) of nitrogen x and the Vickers hardness Hv of a product obtained by applying SR forming to a high-nitrogen austenite steel ($Fe_{65-x}Cr_{20}Ni_8Mn_5Nb_2N_x$ (% by mass, and x=0.45, 0.7, and 0.9) mechanical alloying (MA) sample are shown in Table 6, given below.

TABLE 6

Relationships between the concentration (content) of nitrogen x and the Vickers hardness Hv of a product obtained by applying SR forming to a high-nitrogen austenite steel ($Fe_{65-x}Cr_{20}Ni_8Mn_5Nb_2N_x$ (% by mass, and x = 0.45, 0.7, and 0.9) mechanical alloying (MA) sample (the forming temperature: 900° C.)

| | Concentration of nitrogen (% by mass) | | |
|---|---|---|---|
| | 0.45 | 0.7 | 0.9 |
| Hv | 500 | 600 | 750 |

Example 15

The relationships between the content of nitrogen and the Vickers hardness Hv of austenite steel (the effect of solid-solution of nitrogen) are shown in Table 7.

TABLE 7

Relationships between the content of nitrogen and the Vickers hardness Hv of austenite steel - the effect of solid-solution of nitrogen

| Sample Nitrogen | (% by mass) | Hv | Crystal Grain Diameter D (nm) |
|---|---|---|---|
| a | 0.035 | 400 | 35 |
| b | 0.9 | 750 | 30 |

a: SR formed sheet obtained by applying MA, strictly MM (mechanical milling) to SUS 304 stainless steel powders for 10 hours, followed by annealing (1,150° C. × 15 minutes/water cooling).
b: SR formed sheet obtained at 900° C., using 200-hour MA treated $Fe_{64.1}Cr_{20}Ni_8Mn_5Nb_2N_{0.9}$ (% by mass) powders.

Example 16

The relationships between the mean crystal grain diameter D and the Vickers hardness Hv of austenite steel (the effect of MA on the reduction of crystal grains) are shown in Table 8.

TABLE 8

Relationships between the mean crystal grain diameter D and the Vickers hardness Hv of austenite steel - the effect of MA on the reduction of crystal grains

| Sample | D (nm) | Hv |
|---|---|---|
| A | 75,000 | ≦200 |
| B | 35 | 400 |

A: SUS 304 stainless steel sheet prepared by melting (N: about 0.035% by mass), and
B: SR formed sheet obtained by applying MA to SUS 304 stainless steel powders for 10 minutes, and then applying SR forming to the resulting powders at 900° C., followed by annealing (l,150° C. × 15 minutes/water quenching).

From Example 15 (Table 7) and Example 16 (Table 8), it has been found that as the concentration of nitrogen of the mechanically alloyed (MA) austenitic material is brought up to 0.9% by mass, the hardness of that material is increased to about 8 times as high as that of the SUS 304 sheet prepared by melting, and that not only the effect of solid-solution of nitrogen but also the effect of MA on the reduction of crystal grains contributes greatly to this.

POSSIBLE APPLICATIONS OF THE INVENTION TO THE INDUSTRY

The austenite steel bulk materials obtained herein are now explained with reference to what purposes they are used for.

High-Nitrogen Austenite Steel

High-nitrogen austenite steel materials have common properties as mentioned below. They have super strength and toughness, and show pitting corrosion resistance and non-magnetism as well. In addition, they do not undergo sharp softening from the temperature of near 200 to 300° C. upon temperature rises, which is usually experienced with steel materials of the martensite or ferrite type, and they are less susceptible to low-temperature brittleness at a temperature at or lower than room temperature.

Another important feature of noteworthiness is that one exemplary high-nitrogen nano-crystal stainless steel of the invention having a nitrogen concentration of about 0.9% by mass that is equivalent in composition in austenitic stainless steel SUS 304 has a hardness about four times (that exceed the hardness of the martensite structure of high-carbon steel) and an offset yield strength six times (that are equivalent to that of ultra-high tensile strength steel) as high as those of that 304 stainless steel. In addition, even a material having such extremely high offset yield strength does not induce any delayed fracture unlike steel materials of the martensite or ferrite type.

Thus, the high-nitrogen nano-crystal austenite steel materials of the invention, because of having such features as mentioned above, can suitably find a wide spectrum of applications inclusive of high tensile strength bolts or bulletproof materials, for instance, as materials for mechanical parts and hot-processing super hard tools, given below.

(1) High Tensile Strength Bolts and Nuts (Mechanical Clamping Materials)

Usually, martensitic or ferritic steel materials are often used for high tensile strength bolts and nuts. However, such martensitic or ferritic materials, if they have a tensile strength of 70 to 80 kg/mm$^2$ or greater, are susceptible to delayed fracture even under a static tensile force that is lower than the yielding point (offset yield strength). For this reason, those materials are not used as yet for high tensile strength bolts and nuts having a tensile strength of 70 to 80 kg/mm$^2$ or greater.

However, the high-nitrogen nano-crystal austenite steel of the invention, because of having an extremely high strength and because its structure is made up of an austenite phase, is unlikely to induce such delayed fracture as described above. In view of such properties of the nano-crystal austenite steel as referred to above, thus, the nano-crystal austenite steel bulk materials of the invention could be used not just as materials for the aforesaid high tensile strength bolts, but they could also be used as components of airplanes and automobiles that must now decrease increasingly in weight; for the inventive materials there might be immeasurable demands.

(2) Bulletproof Steel Sheets, and Bulletproof Vests

For instance, the weight of each bulletproof vest now used for military purposes is said to reach 40 to 50 kg when put on in action or the like. In addition, that vest must have much higher performance, as expressed in terms of a tensile strength of 250 kg/mm$^2$ and an elongation of 5 to 10%. However, never until now is any material that meets such high performance requirement developed.

(3) Bearings

Most of steel materials for bearing materials are only used in a relatively narrow temperature range, because of the instability of the martensite structure that forms the phase matrix of frictional and wearing portions. However, the high-nitrogen austenite steel of the invention could be used in a wider temperature range than ever before, because of no sharp strength or hardness drop in a high-temperature region, for instance, until temperatures of near 600° C. are reached.

Especially when the high-nitrogen austenite steel of the invention used for the rotary parts of bearings, the amount of that material used can be much reduced because of its strength properties, so that not only can the material used be greatly saved, but it is also possible to achieve great power savings during bearing operation through a large lowering of centrifugal force of the moving part of the bearing.

(4) Gears

Steel materials used for most of gears must meet contradictory requirements of giving wear resistance to the surface (tooth face) portion of, and strong toughness to the interior of, one single gear, resulting in the need of surface hardening treatment that relies on a sophisticatedly combined technique and skill comprising carburizing to the tooth face portion, etc. and hardening and tempering. When the super hard and tough, high-nitrogen nano-crystal austenite steel prepared as by extrusion according to the invention is used for this purpose, however, such surface hardening treatment can be dispensed with.

Gears composed of the high-nitrogen nano-crystal austenite steel could also be used in a wider temperature range as compared with ordinary gears having tooth face portions made up of a martensite (instable) phase.

(5) Tools for Hot Processing and Extrusion

Hardened and tempered materials often used as high-temperature cutting tools, for instance, molybdenum based high-speed steel materials, have the nature of softening rapidly at a temperature higher than near 400° C. owing to the fact that the matrix is composed of a tempered martensite phase that becomes instable upon temperature rises. However, the high-nitrogen nano-crystal austenite steel of the invention, because its matrix is composed in itself of a stable phase, could be used as more favorable materials for tools dedicated to hot processing.

The high-nitrogen nano-crystal austenite steel of the invention, also because its matrix is relatively thermally stable, could be more effectively used for extrusion tools exposed to vigorous thermal changes during use.

(6) Medical Tools or the Like

In Europe and America, the use of austenitic steel like a chromium-nickel type SUS 304 steel in human-related fields is now being placed under bans, owing to possible problems that nickel ions dissolved during use, if not in large amounts, cause inflammation of the skin of the human body. A high-nitrogen chromium-manganese type austenite stainless steel is among nickel-free austenitic steel materials attracting attentions from such backgrounds.

The non-magnetic, high-nitrogen nano-crystal chromium-manganese type austenite steel of the invention possesses super hardness and toughness with an improved corrosion resistance (pitting corrosion resistance), and has a feature of being unlikely to embrittle by virtue of the nature of the austenite phase even at low temperatures as well.

In view of such properties of the high-nitrogen chromium-manganese type austenite steel as mentioned above, the non-magnetic, high-nitrogen chromium-manganese type austenite steel of the invention could provide promising materials for surgeon's knives, medical low-temperature tools, sharp-edged tools like general-purpose knives and scissors, tools such as drills and so on.

What we claim is:

1. A super hard and tough austenite steel bulk material with an improved corrosion resistance, comprising an aggregate of austenite nano-crystal grains containing 0.1 to 2.0% (by mass) of nitrogen in solid-solution wherein said austenite nano-crystal grains are obtained by mechanical alloying (MA) using a ball mill or the like, and wherein some amount of a metal oxide or a semi-metal oxide is inevitably formed on the surface of MA powder products during MA processing, acting as a crystal grain growth inhibitor between or in said nanocrystal grains, or between and in said nano crystal grains, wherein said bulk material comprising an aggregate of austenite nano-crystal grains containing 0.1 to 2.0% (by mass) of nitrogen in solid solution has a steel forming and blending composition comprising 4 to 40% (by mass) of Mn, 0.1 to 2.0% (by mass) of N, 0.1 to 2.0% (by mass) of C and 3 to 10% (by mass) of Cr with the rest being substantially Fe.

2. A super hard and tough austenite steel bulk material with an improved corrosion resistance, comprising an aggregate of austenite nano-crystal grains containing of 0.1 to 2.0% (by mass) of nitrogen in solid solution, wherein said austenite nanocrystal grains are obtained by mechanical alloying (MA) using a ball mill or the like, and wherein an amount of a metal oxide or a semi-metal oxide is inevitably formed on the surface of MA powder products during MA processing, acting as a crystal grain growth inhibitor between or in said nano-crystal grains, or between and in said nano crystal grains, and wherein at least one or two selected from the group consisting of (1) a metal oxide or a semimetal oxide, (2) a metal silicide or a semimetal silicide and (3) a metal boride or a semimetal boride exist as a crystal grain growth inhibitor between and/or in said nano-crystal grains, wherein said bulk material comprising an aggregate of austenite nano-crystal grains containing 0.1 to 2.0% (by mass) of nitrogen in solid solution has a steel forming and blending composition comprising 4 to 40% (by mass) of Mn, 0.1 to 2.0% (by mass) of N, 0.1 to 2.0% (by mass) of C and 3 to 10% (by mass) of Cr with the rest being substantially Fe.

3. The super hard and tough nano-crystal austenite steel bulk material with an improved corrosion resistance according to claim 1 or 2, wherein said austenite steel bulk material comprising an aggregate of austenite nano-crystal grains containing 0.1 to 2.0% (by mass) of nitrogen in solid solution contains in a structure thereof an amount of ferrite nano-crystal grains.

4. The super hard and tough nano-crystal austenite steel bulk material with an improved corrosion resistance according to any one of claims 1 or 2, wherein said bulk material comprising an aggregate of austenite nano-crystal grains containing 0.1 to 2.0% (by mass) of nitrogen in solid solution comprises a nitrogen-affinity metal element that has a stronger chemical affinity for nitrogen than iron, said nitrogen-affinity metal element selected from the group consisting of niobium, tantalum, manganese, and chromium, so as to prevent denitrification during a forming-by-sintering process thereof.

5. The super hard and tough nano-crystal austenite steel bulk material with an improved corrosion resistance according to claim 1 or 2, wherein said bulk material comprising an aggregate of austenite nano-crystal grains containing 0.1 to 2.0% (by mass) of nitrogen in solid solution has a steel forming and blending composition comprising 12 to 30% (by mass) of Cr, 0 to 20% (by mass) of Ni, 0 to 30% (by mass) of Mn, 0.1 to 2.0% (by mass) of N and 0.02 to 1.0% (by mass) of C with the rest being substantially Fe.

6. The super hard and tough nano-crystal austenite steel bulk material with an improved corrosion resistance according to claim 1 or 2, which comprises an aggregate of austenite nano-crystal grains containing 0.3 to 1.0% (by mass) of a nitrogen in solid solution and having a crystal grain diameter of 50 to 1,000 nm.

7. The super hard and tough nano-crystal austenite steel bulk material with an improved corrosion resistance according to claim 1 or 2, which comprises an aggregate of austenite nano-crystal grains containing 0.4 to 0.9% (by mass) of a solid-solution type nitrogen and having a crystal grain diameter of 75 to 500 nm.

8. The super hard and tough nano-crystal austenite steel bulk material with an improved corrosion resistance according to claim 1 or 2, which comprises an aggregate of austenite nanocrystal grains containing 0.4 to 0.9% (by mass) of a nitrogen in solid solution and having a crystal grain diameter of 100 to 300 nm.

9. The super hard and tough nano-crystal austenite steel bulk material with an improved corrosion resistance according to claim 3, wherein said bulk material comprising an aggregate of austenite nano-crystal grains containing 0.1 to 2.0% (by mass) of nitrogen in solid solution comprises a nitrogen-affinity metal element that has a stronger chemical affinity for nitrogen than iron, said nitrogen-affinity metal element selected from the group consisting of niobium, tantalum, manganese, and chromium, so as to prevent denitrification during a forming-by-sintering process thereof.

10. The super hard and tough nano-crystal austenite steel bulk material with an improved corrosion resistance according to claim 3, wherein said bulk material comprising an aggregate of austenite nano-crystal grains containing 0.1 to 2.0% (by mass) of nitrogen in solid solution has a steel forming and blending composition comprising 12 to 30% (by mass) of Cr, 0 to 20% (by mass) of Ni, 0 to 30% (by mass) of Mn, 0.1 to 2.0% (by mass) of N and 0.02 to 1.0% (by mass) of C with the rest being substantially Fe.

11. The super hard and tough nano-crystal austenite steel bulk material with an improved corrosion resistance according to claim 4, wherein said bulk material comprising an aggregate of austenite nanocrystal grains containing 0.1 to 2.0% (by mass) of nitrogen in solid solution has a steel forming and blending composition comprising 12 to 30% (by mass) of Cr, 0 to 20% (by mass) of Ni, 0 to 30% (by mass) of Mn, 0.1 to 2.0% (by mass) of N and 0.02 to 1.0% (by mass) of C with the rest being substantially Fe.

12. A super hard and tough austenite steel bulk material with an improved corrosion resistance, comprising an aggregate of austenite nano-crystal grains containing 0.1 to 2.0% (by mass) of nitrogen in solid-solution wherein said austenite nano-crystal grains are obtained by mechanical alloying (MA) using a ball mill or the like, and wherein some amount of a metal oxide or a semi-metal oxide is inevitably formed on the surface of MA powder products during MA processing, acting as a crystal grain growth inhibitor between or in said nanocrystal grains, or between and in said nano crystal grains, wherein said austenite steel bulk material comprising an aggregate of austenite nanocrystal grains containing 0.1 to 2.0% (by mass) of nitrogen in solid solution contains in a structure thereof an amount of ferrite nano-crystal grains, and wherein said bulk material comprising an aggregate of austenite nano-crystal grains containing 0.1 to 2.0% (by mass) of nitrogen in solid solution has a steel forming and blending composition comprising 4 to 40% (by mass) of Mn, 0.1 to 2.0% (by mass) of N, 0.1 to 2.0% (by mass) of C and 3 to 10% (by mass) of Cr with the rest being substantially Fe.

13. A super hard and tough austenite steel bulk material with an improved corrosion resistance, comprising an aggregate of austenite nano-crystal grains containing 0.1 to 2.0% (by mass) of nitrogen in solid-solution wherein said austenite nano-crystal grains are obtained by mechanical alloying (MA) using a ball mill or the like, and wherein some amount of a metal oxide or a semi-metal oxide is inevitably formed on the surface of MA powder products during MA processing, acting as a crystal grain growth inhibitor between or in said nano-crystal grains, or between and in said nano crystal grains, wherein said bulk material comprising an aggregate of austenite nano-crystal grains containing 0.1 to 2.0% (by mass) of nitrogen in solid solution comprises a nitrogen-affinity metal element that has a stronger chemical affinity for nitrogen than iron, said nitrogen-affinity metal element selected from the group consisting of niobium, tantalum, manganese, and chromium, so as to prevent denitrification during a forming-by-sintering process thereof, and wherein said bulk material comprising an aggregate of austenite nano-crystal grains containing 0.1 to 2.0% (by mass) of nitrogen in solid solution has a steel forming and blending composition comprising 4 to 40% (by mass) of Mn, 0.1 to 2.0% (by mass) of N, 0.1 to 2.0% (by mass) of C and 3 to 10% (by mass) of Cr with the rest being substantially Fe.

14. The super hard and tough nano-crystal austenite steel bulk material with an improved corrosion resistance according to claim 3, which comprises an aggregate of austenite nano-crystal grains containing 0.3 to 1.0% (by mass) of a nitrogen in solid solution and having a crystal grain diameter of 50 to 1,000 nm.

15. The super hard and tough nano-crystal austenite steel bulk material with an improved corrosion resistance according to claim 4, which comprises an aggregate of austenite nano-crystal grains containing 0.3 to 1.0% (by mass) of a nitrogen in solid solution and having a crystal grain diameter of 50 to 1,000 nm.

16. The super hard and tough nano-crystal austenite steel bulk material with an improved corrosion resistance according to claim 5, which comprises an aggregate of austenite nano-crystal grains containing 0.3 to 1.0% (by mass) of a nitrogen in solid solution and having a crystal grain diameter of 50 to 1,000 nm.

17. The super hard and tough nano-crystal austenite steel bulk material with an improved corrosion resistance according to claim 1 or 2, which comprises an aggregate of austenite nano-crystal grains containing 0.3 to 1.0% (by mass) of a nitrogen in solid solution and having a crystal grain diameter of 50 to 1,000 nm.

18. The super hard and tough nano-crystal austenite steel bulk material with an improved corrosion resistance according to claim 3, which comprises an aggregate of austenite nano-crystal grains containing 0.4 to 0.9% (by mass) of a solid-solution type nitrogen and having a crystal grain diameter of 75 to 500 nm.

19. The super hard and tough nano-crystal austenite steel bulk material with an improved corrosion resistance according to claim 4, which comprises an aggregate of austenite nano-crystal grains containing 0.4 to 0.9% (by mass) of a solid-solution type nitrogen and having a crystal grain diameter of 75 to 500 nm.

20. The super hard and tough nano-crystal austenite steel bulk material with an improved corrosion resistance according to claim 5, which comprises an aggregate of austenite nano-crystal grains containing 0.4 to 0.9% (by mass) of a solid-solution type nitrogen and having a crystal grain diameter of 75 to 500 nm.

21. The super hard and tough nano-crystal austenite steel bulk material with an improved corrosion resistance according to claim 1 or 2, which comprises an aggregate of austenite nanocrystal grains containing 0.4 to 0.9% (by mass) of a solid-solution type nitrogen and having a crystal grain diameter of 75 to 500 nm.

22. The super hard and tough nano-crystal austenite steel bulk material with an improved corrosion resistance according to claim 3, which comprises an aggregate of austenite nano-crystal grains containing 0.4 to 0.9% (by mass) of a nitrogen in solid solution and having a crystal grain diameter of 100 to 300 nm.

23. The super hard and tough nano-crystal austenite steel bulk material with an improved corrosion resistance according to claim 4, which comprises an aggregate of austenite nano-crystal grains containing 0.4 to 0.9% (by mass) of a nitrogen in solid solution and having a crystal grain diameter of 100 to 300 nm.

24. The super hard and tough nano-crystal austenite steel bulk material with an improved corrosion resistance according to claim 5, which comprises an aggregate of austenite nano-crystal grains containing 0.4 to 0.9% (by mass) of a nitrogen in solid solution and having a crystal grain diameter of 100 to 300 nm.

25. The super hard and tough nano-crystal austenite steel bulk material with an improved corrosion resistance according to claim 1 or 2, which comprises an aggregate of austenite nano-crystal grains containing 0.4 to 0.9% (by mass) of a nitrogen in solid solution and having a crystal grain diameter of 100 to 300 nm.

26. A super hard and tough austenite steel bulk material with an improved corrosion resistance, comprising an aggregate of austenite nano-crystal grains containing of 0.1 to 2.0% (by mass) of nitrogen in solid solution, wherein said austenite nano-crystal grains are obtained by mechanical alloying (MA) using a ball mill or the like, and wherein an amount of a metal oxide or a semi-metal oxide is inevitably formed on the surface of MA powder products during MA processing, acting as a crystal grain growth inhibitor between or in said nano-crystal grains, or between and in said nano crystal grains, and wherein at least one or two selected from the group consisting of (1) a metal oxide or a semimetal oxide, (2) a metal silicide or a semimetal silicide and (3) a metal boride or a semimetal boride exist as a crystal grain growth inhibitor between and/or in said nano-crystal grains, wherein said austenite steel bulk material comprising an aggregate of austenite nanocrystal grains containing 0.1 to 2.0% (by mass) of nitrogen in solid solution contains in a structure thereof an amount of ferrite nano-crystal grains, and wherein said bulk material comprising an aggregate of austenite nano-crystal grains containing 0.1 to 2.0% (by mass) of nitrogen in solid solution has a steel forming and blending composition comprising 4 to 40% (by mass) of Mn, 0.1 to 2.0% (by mass) of N, 0.1 to 2.0% (by mass) of C and 3 to 10% (by mass) of Cr with the rest being substantially Fe.

27. A super hard and tough austenite steel bulk material with an improved corrosion resistance, comprising an aggregate of austenite nano-crystal grains containing of 0.1 to 2.0% (by mass) of nitrogen in solid solution, wherein said austenite nanocrystal grains are obtained by mechanical alloying (MA) using a ball mill or the like, and wherein an amount of a metal oxide or a semimetal oxide is inevitably formed on the surface of MA powder products during MA processing, acting as a crystal grain growth inhibitor between or in said nano-crystal grains, or between and in said nano crystal grains, and wherein at least one or two selected from the group consisting of (1) a metal oxide or a semimetal oxide, (2) a metal silicide or a semimetal silicide and (3) a metal boride or a semimetal boride exist as a crystal grain growth inhibitor between and/or in said nano-crystal grains, wherein said bulk material comprising an aggregate of austenite nanocrystal grains containing 0.1 to 2.0% (by mass) of nitrogen in solid solution comprises a nitrogen-affinity metal element that has a stronger chemical affinity for nitrogen than iron, said nitrogen-affinity metal element selected from the group consisting of niobium, tantalum, manganese, and chromium, so as to prevent denitrification during a forming-by-sintering process thereof, and wherein said bulk material comprising an aggregate of austenite nano-crystal grains containing 0.1 to 2.0% (by mass) of nitrogen in solid solution has a steel forming and blending composition comprising 4 to 40% (by mass) of Mn, 0.1 to 2.0% (by mass) of N, 0.1 to 2.0% (by mass) of C and 3 to 10% (by mass) of Cr with the rest being substantially Fe.

* * * * *